US006340140B1

(12) United States Patent
Lochschmidt

(10) Patent No.: US 6,340,140 B1
(45) Date of Patent: Jan. 22, 2002

(54) RAILROAD FROG FOR SWITCH POINTS AND CROSSINGS

(76) Inventor: Oswald Lochschmidt, Theodor-Storm-Strasse 4, 51429 Bergisch Gladbach 1 (DE)

( * ) Notice: Subject to any disclaimer, the term of this patent is extended or adjusted under 35 U.S.C. 154(b) by 0 days.

(21) Appl. No.: 09/242,755

(22) PCT Filed: Aug. 21, 1997

(86) PCT No.: PCT/EP97/04561

§ 371 Date: Jun. 14, 1999

§ 102(e) Date: Jun. 14, 1999

(87) PCT Pub. No.: WO98/07928

PCT Pub. Date: Feb. 26, 1998

(30) Foreign Application Priority Data

Aug. 21, 1996 (DE) ..... 196 33 694

(51) Int. Cl.[7] ..... E01B 7/10

(52) U.S. Cl. ..... 246/454; 246/458; 246/468; 246/274; 246/275; 246/382

(58) Field of Search ..... 246/274, 275, 246/276, 257, 358, 382, 387, 389, 392, 454, 457, 458, 468

(56) References Cited

U.S. PATENT DOCUMENTS

| | | | | |
|---|---|---|---|---|
| 1,905,736 A | * | 4/1933 | Muchnic | 246/276 |
| 2,036,198 A | * | 4/1936 | Cooper et al. | 246/276 |
| 3,819,935 A | * | 6/1974 | Lindner | 246/435 |
| 4,168,817 A | * | 9/1979 | Pirker et al. | 246/391 |
| 4,637,578 A | * | 1/1987 | Frank | 246/391 |
| 4,953,814 A | * | 9/1990 | Oswald et al. | 246/382 |
| 5,782,437 A | * | 7/1998 | Irie et al. | 246/276 |

FOREIGN PATENT DOCUMENTS

| | | | | |
|---|---|---|---|---|
| DE | 60 326 A | | 11/1968 | |
| DE | 24 54 184 A | | 5/1976 | B23K/23/00 |
| DE | 33 39 442 C1 | | 5/1985 | E01B/7/12 |
| DE | 37 08 233 A1 | | 9/1988 | E01B/7/14 |
| EP | 0 281 880 B1 | | 2/1988 | E01B/7/14 |
| EP | 0 282 796 B1 | | 2/1988 | E01B/7/12 |
| EP | 0282796 A | * | 9/1988 | 246/382 |
| EP | 0 716 185 A1 | | 11/1995 | E01B/7/12 |

(List continued on next page.)

OTHER PUBLICATIONS

Search Report for PCT/EP97/04561 dated Dec. 22, 1997, pp. 1–2.

*Primary Examiner*—S. Joseph Morano
*Assistant Examiner*—Frantz F. Jules
(74) *Attorney, Agent, or Firm*—Senniger, Powers, Leavitt & Roedel

(57) ABSTRACT

The rigid frog for switch points and crossings with two wing rails (1, 2) and a frog point (3, 6, 4, 5) arranged therebetween, which forms with the wing rails switch openings (11) that run at an acute angle relative to each other, is characterized in that the frog point and the wing rails are elastically joined by anchor clamps on each foot side to ribbed plates (247–253). The previous unit of a rigid frog with wing rails and HB bolted point is thus resolved to individual rails. The individual rails each have their own intrinsic elasticity so that the frog behaves like a normal rail in the track in terms of oscillation and damping behavior. The previously used filling plates are no longer required. Beneath the rails are plates with which a height adjustment, especially of the wing rails (1, 2), can be effected, so that wear of the traversed surface of the wing rails can be compensated for in terms of height by changing the thickness of the spacers. The spacers (42, 43) can be elastic. Transverse to the longitudinal axis of the rails, the rail parts are secured essentially without play by ribs (39, **39*a*, 39*b*, 40, 41). In order to rule out longitudinal shifting of the point relative to the two wing rails, a correspondingly designed rail anchor is arranged in the region of the wing rail ends (FIG. 1**).

13 Claims, 17 Drawing Sheets

FOREIGN PATENT DOCUMENTS

| | | | | | |
|---|---|---|---|---|---|
| FR | 2 372 931 | | | 6/1978 | ..... E01B/7/10 |
| GB | 282796 | A | * | 9/1988 | ..... 246/382 |
| GB | 282-796 | A | * | 9/1988 | |
| GB | 0716185 | A1 | * | 11/1995 | ..... E01B/7/12 |
| LU | 34.773 | A | | 1/1957 | |
| WO | WO 94/02683 | | | 2/1994 | ..... E01B/7/12 |

* cited by examiner 1
2
3
4
5
6
11
12
13
26
27
28
29
30
31
32
33
34
35
36
37
246
247
248
249
250
251
252
253
223
A
D

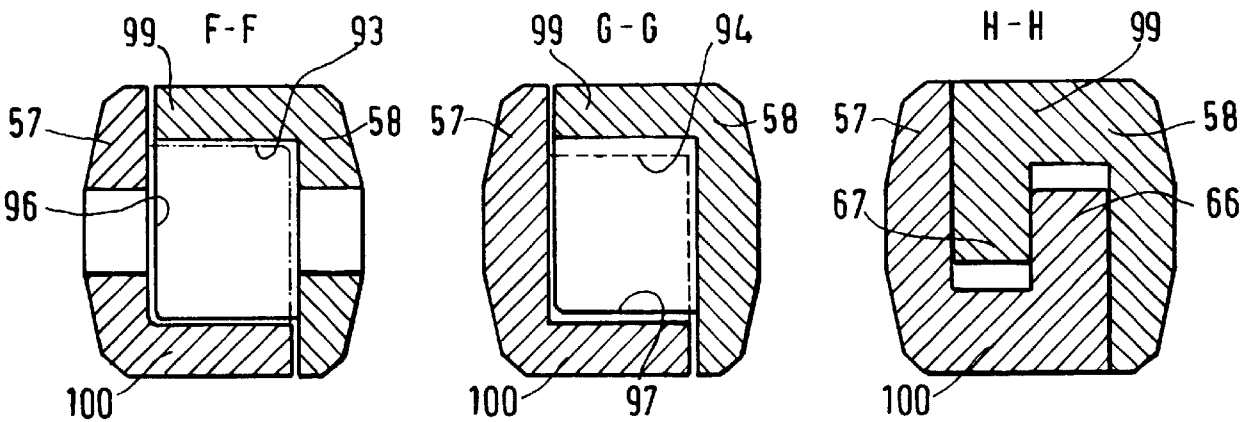
FIG.15c
FIG.15b
FIG.15a
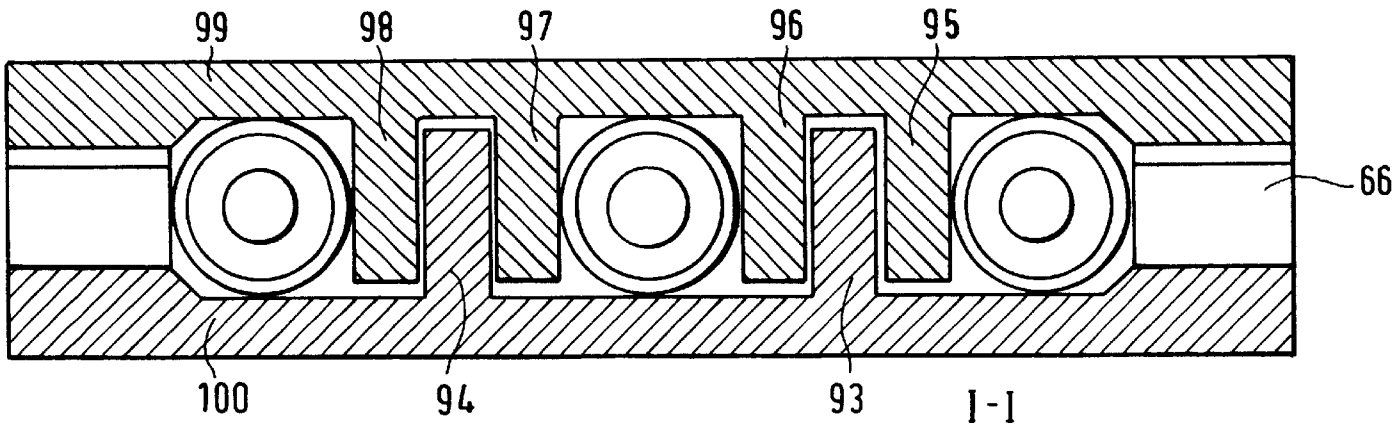
I-I
FIG.14

RAILROAD FROG FOR SWITCH POINTS AND CROSSINGS

The invention pertains to a railroad frog for switch points and crossings. This type of frog is known from EP 0,282,796. As in all known frogs, the wing rails are separated from the frog point by filling plates in order to ensure the proper flange groove width. To guarantee a certain elasticity of the individual components of this frog, a bushing is passed through the frog with play, where this bushing is supported on both sides by the spacer element on the filling plates, which in turn lie on the fishplate seating surfaces of the wing rails. The wing rails are tightened together with a bolt, so that the filling plate, the spacer element, and the bushing thus together form a rigid unit. Only the frog point can move horizontally and vertically relative to the two wing rails with the stipulated amount of play. The two wing rails and the frog lie on a ribbed plate, which has vertically protruding ribs that serve as stops for the feet of the wing rails and the frog point for horizontal movement and permit the desired horizontal mobility based on the stipulated horizonal.

WO 94/02683 discloses a frog that is assembled from two unwelded rail sections screwed together via filling plates and a bolt that passes through the connector of the wing rails and the frog. To keep both unwelded rail parts of the frog point in a defined position relative to each other, the rail sections of the frog are penetrated without play by a bushing, or the opposing surfaces of the frog section are joined by a profile or indentation running in the longitudinal direction whose tooth flanks lie against each other without play.

A frog similar to EP 0,282,796 is also known from EP 0,281,880 B1 and DE 37,08,233 A1.

Simple, rigid frogs are generally arranged in switch points at the places where the inner wheel flange intersects the two treads in the crossing region for problem-free traversal. The wheel rims are so wide that they cover the groove width and the width of the still load-bearing point of the frog point. During the free passage of the flange, the wheel rims that transfer the wheel load must allow problem-free traversal over intersecting treads without destruction of the narrow frog point.

The rigid, simple frogs assembled from rails with the three main parts (i.e., the two wing rails and the single frog point) are bolted together via filling plates, which is also intended to prevent longitudinal shifting due to temperature fluctuations and braking. These threaded joints of the rigid, simple frogs now designed as HB (high-strength, bolted) threaded joints exhibit significant technical deficiencies, as well as very high manufacturing and maintenance costs, which adversely affects service life. The very high manufacturing costs are primarily attributed to the fact that filled section rails of the corresponding rail profile are used for the point instead of the standard rails otherwise common on the track at switch points. In order to be able to weld the welding cross section of the two points consisting of filled section rails, both the main point and the wing rail must be machined generally up to at most halfway in the critical region. Before welding these two cross sections into a single frog point, the area being welded must be preheated to about 400–500° C. so that no cracks form during welding of the highly carburized rail steel. This temperature must be maintained throughout welding. However, it is generally not held at this level, so that martensite formation occurs in the welding area and the welds crack, even after a short time, or the point rails break, which today is still, unfortunately, very often the case.

Moreover, the region of transfer of the wheel from the wing rail to the point or vice versa is often hardened or pearlitized in order to reduce wear. Decarburizations that lead to lower strength of this area, however, develop in the initial and end region during hardening or pearlitization, which in practice leads to increased maintenance costs due to so-called switch dents after brief operation.

It is also known from DE 33,39,442 C1 that the frog point can be provided with a recess in the region of the greatest wear, especially in the initial region, into which a frog insert made of high-carbon manganese steel is firmly fitted. The high-carbon manganese steel is secured by a press-fit produced by a low-temperature shrinkage process. This process does lengthen the service life of the frog point, but is very complicated and expensive and creates an almost inelastic frog point.

Holes can be drilled through both the frog block and the wing rails, which, on the one hand, entails high costs and, on the other, leads to rail breaks if the hole edges are not properly deburred. Joining of the filling plate support surfaces with the fishplate seating surfaces of the wing rails as free from play as possible requires high manufacturing costs. The main cause of high wear, and thus relatively short service life, is the unduly high rigidity of the transitional region of the wheel from the wing rail to the point and vice versa because of the unduly compact cross section, i.e., the total moments of inertia about the X axis, the combination of wing rail, frog points and filling plates. It was already recognized in EP 0,282,796 that these problems could be solved by greater elasticity than before, i.e., by a relative vertical displaceability between the frog point and wing rail so as to support only limited forces in the weak region of the frog point and high forces in the regions of greater rail cross section. Owing to the fact that both wing rails are still rigidly coupled via the frog point, their moments of inertia are still relatively high. The frog point is also mounted there to achieve a bending rod function, like a jib, i.e., its free end can be deflected vertically, whereas the rear region is rigidly fixed. The front region of the frog point thus bends downward when traversed and the tread is stressed in the region where the train is located, which has led to rail breaks even after a short period of operation.

If one compares the inertia, i.e., the moment of inertia of the transitional region of two wing rails, two filling plates and, if necessary, the filled section rail points, it can easily be seen that this type of transitional region acts like a rigid block that causes compressive deformation in the impact region because of its rigidity. If we further consider that railroad wheels are not perfectly round, which is caused possibly by the high rigidity of the impact point and point-like or even bluntly run-over single frogs, it becomes clear that this is an additional major cause of wear. To eliminate this wear due to orthogonal compressive deformation on the frog point and the wing rails during operation, both the point and the wing rails are resurfaced by welding under practical conditions on the track. This resurfacing by welding is often not carried out skillfully, especially if the weld is not sufficiently preheated, which results in the frog breaking by martensite formation after a short time and its replacement.

The horizontal rigidity, which corresponds to a multiple of that for a single rail because of the very high moment of inertia of the entire rim frog about the Y axis, also excessively loads the guardrails. In order to reduce wear on the guardrails, the wing rails should be designed to be horizontally elastic, especially on contact with the rear wheel sets of the wheels.

The greatest tracking defect of current frogs lies in the fact that the wing rails are not cambered in accordance with the conicity of the form of the running wheel. Thus, during traversal of the point the axle of the wheelset at the equal height wing rails is significantly lowered vertically and thus strongly accelerated vertically. The wheel contact surface point then wanders farther from the running edge to the smaller diameters of the rim, which results in significantly lower circumferential velocity of the wheel on the frog side, whereas the wheel of the wheelset on the inner curve runs on a larger diameter of the wheel contact surface point because the wheelset is pulled toward the guardrail. This phenomenon can also be viewed as a paradox, since, because of the guardrail, the wheel running on the outside of the arc runs over a much smaller diameter than the wheel running on the inside of the arc.

Since the current frog point is lowered into a tread that tapers off to a point opposite the running direction upon passing over the point when the wheelset goes from the wing rail to the rigid frog point, in addition to the sudden change from smaller to larger diameter wheel contact surface, i.e., to a much greater circumferential velocity, it is also opposed to the previous direction of acceleration, namely "catapulted" not downward, but obliquely upward in the opposite direction. This is the reason for plastic compressive deformation of the tread of the point and probably also the reason for ovalization of the wheel, both for the wheelset and for the impact point on the rigid frog point.

Concerning the elasticity of the previous frog design, it can be stated that the frog generally cast from high-carbon manganese steel and used for more than 100 years, as well as the bolted frog, lies in the switch point practically like a rigid block, i.e., like a foreign body. There is not even a roughly adequate elastic design that would accommodate the elasticity of the standard rail. In bolted frogs, the crossover area generally still lies on a tie, which further increases the rigidity. For this purpose the filling plates are also still arranged in this area so that the moment of inertia about the X axis, which is decisive for elastic vertical bending of the frog point, is roughly more than five times that of a standard rail in the impact cross section. It behaves similarly or even more poorly during traversal from the wing rail to the frog point in cast frogs, and this is even worse in block frogs, because the moment of inertia there is not only five times, but often more than ten times that of a normal standard rail.

All of the aforementioned deficiencies and drawbacks of the simple rigid frogs known thus far, primarily:

- vertical and horizontal rigidity, i.e., unduly limited vertical and horizontal elasticity;
- very significant material waste;
- wasting of resources;
- unduly limited availability of rigid frogs;
- unduly high maintenance costs;
- unduly high new prices;
- no easily-correctable camber;
- inappropriate joining and resurfacing welding and many more, are avoided by the present invention.

The primary object of the invention is to improve the frog of the initially mentioned type, so that with lower manufacturing and material costs a longer service life and greater availability of the frog is achieved in the operating track.

Other objects and features of the present invention will be in part apparent and in part pointed out hereinafter by the features stated in the patent claim. Advantageous embodiments and modifications of the invention can be discerned from the subordinate claims.

The invention proceeds from the recognition that the three main components, i.e., two wing rails and a frog point, can be fully disconnected from each other with respect to their mass or moment of inertia if the filling plates and their threaded joints are eliminated. Because of this, not only is each of the three main parts (two wing rails and a frog point) fully decoupled from the other parts, but additional weight is saved by eliminating the filling plates and threaded joints, thereby further reducing the moment of inertia. The relative position of these three main parts in the horizontal direction is ensured by vertically protruding ribs of a ribbed plate, between which the main parts are held essentially free of play (within narrow tolerances). Vertical elastic attachment of the three main parts occurs by elastic tensioning clamps that tighten the three main parts elastically and vertically only in the plate region. The groove width is guaranteed by the ribs of the ribbed plate and by corresponding machining of the feet and heads of the wing rails and the frog point. The ribbed plates in turn are attached to ties, preferably bolted. Owing to the fact that each of the three main parts can undergo essentially elastical and vertical deformation independently of each other, the previously very high impact when the wheel rim passes from the wing rail to the point or vice versa can be sharply reduced, so that the previous wear due to compressive deformation on the rigid frog point and wing rails is significantly reduced, generally even fully eliminated.

Another important aspect of the invention is that the frog point consists of standard rails that are welded together on the head and foot over the length of the frog point.

According to a modification of the invention a particularly elastic spacer is inserted between the foot of the wing rail or the frog point and the contact surface on the ribbed plates. Thus, each of the three main parts can oscillate with a corresponding natural frequency, which thereby increases elasticity, improves travel comfort, and significantly lengthens the service life.

According to a modification of the invention, in addition to these elastic spacers, spacers of different thickness are possible. Because of this, by insertion of these additional spacers with a specified thickness under the corresponding foot region of the wing rail or the frog point the desired greater height of the traversed surface can be adjusted very exactly without problem. Any wear that has appeared can also be equalized without having to conduct resurfacing welding with subsequent reprofiling of the tread in the region of resurfacing. Maintenance costs can thereby be substantially reduced and, above all, the availability of the object of the invention is raised almost to 100% of its service life in the operating track.

According to the prior art, only the external foot regions of the wing rails have thus far been elastically tightened vertically by anchor clamps or other tightening elements relative to the ribs, in which the tensile forces per tightening side amount to a maximum of 10–15 kN.

According to a modification of the invention, the internal regions of the wing rails and both external foot sides of the frog point are now also tightened by elastic anchor clamps, etc., in which tensile forces of 10–15 kN per tightening point are preferably achieved. Thus, the three regions (frog point and two wing rails) are each tightened as much as the enrim rigid frog used to be. Because of this advantage, the necessary rail anchor, which is supposed to prevent relative shifting of the wing rails and frog point in the longitudinal direction of the rails, turns out to be much more economical and lighter. This type of rail anchor is further described in the subsequent description.

When totally worn out or broken, the wing rail and/or frog point can be easily and quickly replaced, which substantially increases the availability of the object of the invention in the operating track.

The previous service life of rigid, highly loaded, single frogs is, from experience, 3 to 4 years, depending on the load, sometimes even slightly longer. The service life can be substantially increased with the invention, since there are no weak points in either the design or in welding of the two point rails that form the frog point, so that the total cost of a new installation is quite modest relative to the current state of the art.

Another major advantage of the invention lies in the very simple and economical disposal of the frog point or one or both wing rails.

Switching devices, which generally have rigid, single frogs for economic reasons, are often used around residential areas. Because of the completely elastic support points of the wing rails and frog point, sound emissions can be sharply reduced.

Another particular advantage of the invention lies in the easy height adjustability of the treads of the two wing rails, but also the frog point, as compensation for vertical wear and also the rail anchor. Adjustment to the anchor clamps used thus far in tracks and switch points of the "SKL" type common in Germany poses no problem. The contact points of the anchor clamps in the invention are essentially at the same height, in contrast to the ordinary SKL anchor clamps, in which the two contact points are at different heights. In order to reduce the guide force, especially during curved travel between the two wing rails and the two point rails, but also between the frog point and the two wings, the three main components are tightened vertically and elastically with slightly modified anchor clamps in the region of the corresponding support point. Since foot areas of essentially equal height are present between the two wing rails and the two point rails as well as between the two wing rails and the frog point, the known anchor clamps are modified so that the two support areas are at the same height. In this way, the costly filling plates that significantly increase the rigidity of the frog are eliminated.

In order to be able to install a frog according to the invention in the shortest possible time at a given location, the frog is delivered to the site with the corresponding ribbed plates already installed. A single, rigid frog optimized in every respect can thereby be installed without problem in the shortest time possible. Spare parts, like the two wing rails and the frog point, can be stocked so that almost 100% availability of the object of the invention is provided for railroad operation in the shortest time without significant stockkeeping.

The following should be noted concerning the vertical-elastic tightening of the individual support point areas:

In order to keep the foot width of the two wing rails (inside) but also the frog point (outside) as wide as possible and in order to be able to replace the hook screws when necessary without disassembling the rails, the inner bracing ribs are designed to be narrower and higher (with the same load-bearing capacity) than the outer ribs. The aforementioned foot width is determined according to the standard width of the usual hook bolts employed in the SKL fastening, which is 24 mm, which gives a total width of 24 mm with an air gap of 1 mm on each side of the rib. Since the stability of the frog point depends only on the width of the rail foot in the plate region, the ribbed plates are widened so that they do not arch concavely during tightening and "pump" in operation, are preformed convexly, and are produced from fine-grained steel of higher strength.

For heavy-load switch points the foot should only be somewhat narrowed in the inner plate region for half the rib width. Since the length of the rib is forged from one piece and welded to the base plate, the corresponding foot regions are notched only over a maximum length of 120 mm.

For slightly stressed frogs (for example, for service in outlying suburbs), the two feet can be surfaced or milled over their enrim length corresponding to the rib width, which means cost-effective manufacture.

The most important aspects and advantages of the invention will now be summarized:

Frog and wing rails are connected vertically and elastically to the ribbed plates of the ties by anchor clamps (SKL). The previous block unit of a rigid frog and wing rails is thus reduced to individual rails. These individual rails have an intrinsic elasticity so that the object of the invention behaves almost like a normal track rail in terms of oscillation and damping behavior. The previously used filling plates are no longer used, nor are the threaded joints.

The individual rails are more easily replaceable. Additional plastic spacers can subsequently be incorporated beneath the rails, with which stepless height adjustment of the treads is produced. The previous repair of the wing pieces by resurfacing disappears. Tensioning occurs vertically with anchor clamps. The individual rail feet have about 1 mm air relative to each other laterally in the narrow region. The ends of the two standard rails that pass over the enrim length of the frog point without a welded joint and form the point are welded together over the shortest possible area on the head and foot. Welding methods, such as gas pressure welding, $CO_2$ shielded arc welding, inductive pressure welding, electron beam welding or laser welding, are considered here.

In the wheel transition region from the point to the wing rail and vice versa, the latter is cambered so that the height difference of the present conical wheel-rim profile is compensated.

The frog point consists of two standard rails, for example of the type UIC 60, which are adapted by machining in the region of the points on their head and foot regions to the point geometry corresponding to the narrowing in the region and welded to the head and foot of the thus formed point by means of longitudinal V-type seams or other types of seams.

The front region of the point can also be produced in one piece as a forged or cast molded article and welded to the two frog points welded together on the head and foot.

Since there are significant forces acting in the longitudinal direction on the wing rails and frog point due to the effects of temperature and braking, a so-called rail anchor must be provided between the aforementioned three main parts which prevents longitudinal migration with relative displacement between the frog point and wing rails. This rail anchor is incorporated as close as possible to the wheel transition [region] with the special feature that each connector of the wing rails and the frog point is individually bolted very tight to the parts of the rail anchor.

The adjustment of different wing rail heights is necessary to equalize the wear of the rail heads of the wing rails, especially in the wheel transition region. Eccentric bushings are provided between the screws and enlarged holes in the rail connectors for the rail anchor. The rail anchor is then one-piece on each side.

According to one variant, each rail anchor side is designed in two parts with several contact surfaces in the longitudinal and transverse direction that transfer the longitudinal forces from the point to the wing rail and vice versa. These forces are about 600–800 kN, e.g., in the longitudinal direction. Either additional spacers or spacers of different thickness are used beneath the wing rail feet to compensate for height differences as a result of wear of the wing rail treads.

The two matching parts can be shifted perpendicular to each other for a height adjustment of the rails. They can transfer significant forces over several contact surfaces in the longitudinal direction of the rails which are many times greater than in the rail anchor devices of the prior art common in switch blades. A small amount of play between the contact surfaces can moderate the transferable longitudinal rail forces. Movement can also be limited by contact surfaces with play in the transverse rail direction.

The parts of the rail anchor that mesh with each other like a comb can also be designed trapezoidally.

The invention will now be explained in detail below with reference to embodiment examples with reference to the drawing.

BRIEF DESCRIPTION OF THE DRAWINGS

FIG. 14 shows a cross section along line I—I of FIG. 13;

FIGS. 15*a*–15*c* show cross sections along lines F—F, G—G and H—H of FIG. 13, respectively;

Identical reference numbers in the individual figures refer to the same or functionally corresponding parts.

FIG. 1 shows a top view of a frog according to the invention. The two standard rails 4 and 5, which together form the frog point 3, are lengthened beyond the theoretical frog point and welded in the front region to the head and foot as frog point 3. One wing rail, 1 or 2, is arranged on either side of the frog point 3 to form switch openings 11. The aforementioned rail parts lie on ribbed plates 246–253 and 223 (these numbers refer to the nomenclature used by the Deutschen Bahn AG [German Rail System].

Figures 1, 2, 3:
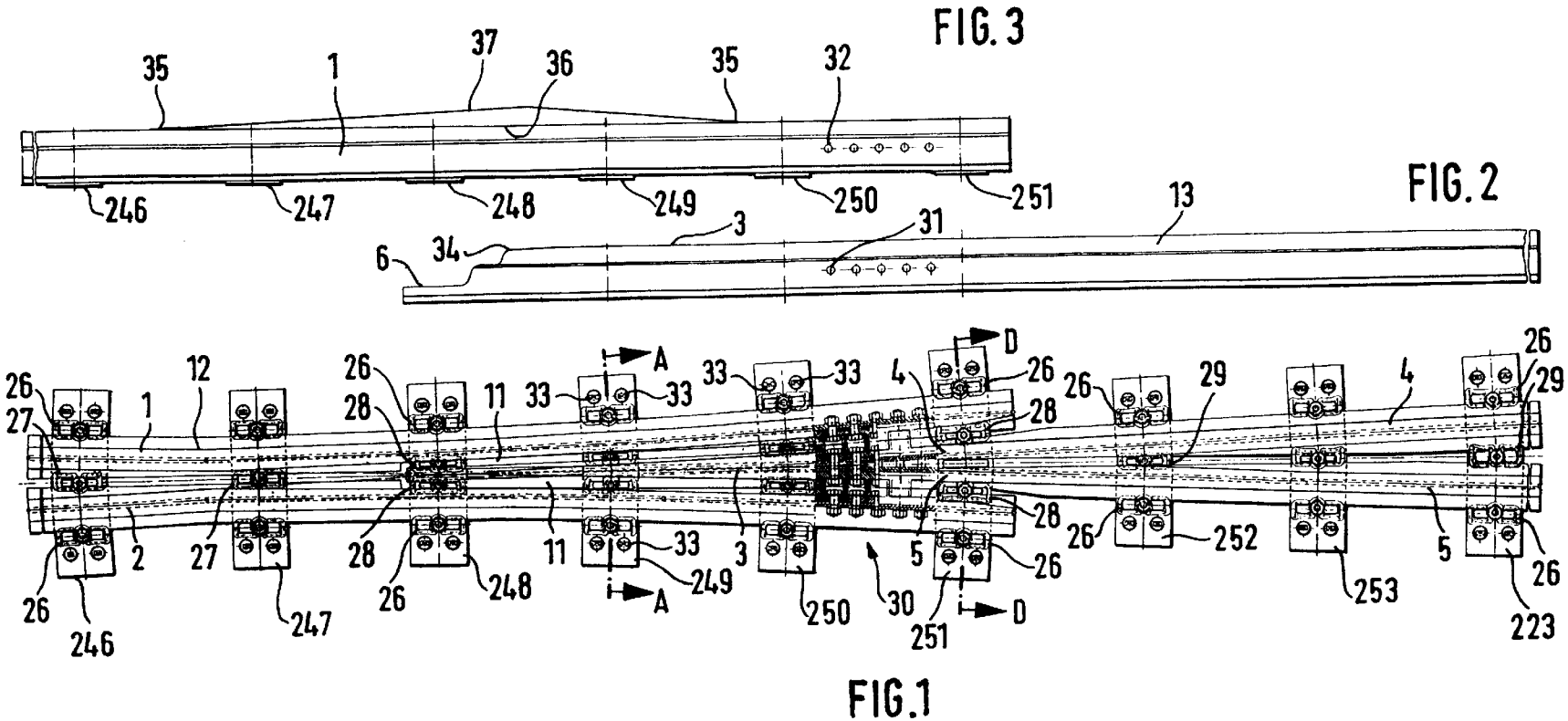
FIG. 1 shows a top view of a frog according to the invention.
FIG. 2 shows a side view of the frog point according to FIG. 1.
FIG. 3 shows a side view of the traversed tread height of the two wing rails according to the invention in the frog of FIG. 1.

In contrast to the prior art, the frog parts, such as wing rails 1 and 2 and frog point 3, are not rigidly connected to each other via filling plates and threaded connections, but are tightened elastically and vertically by anchor clamps 26, 27, 28 and 29 to the corresponding ribbed plate 246–253 and 223. Each wing rail 1 and 2 is tightened on its outer side in the usual manner by anchor clamps 26, where these anchor clamps can be the usual anchor clamps of the SKL 12 type. In the region where the wing rails lie directly opposite each other, i.e., on the ribbed plates 246 and 247, an inner wing rail fastening element is provided in the form of an anchor clamp 27, which presses against the inwardly facing feet of the opposing wing rails 1 and 2. In the regions where the wing rail lies opposite the frog point, point-wing rail fastening elements in the form of anchor clamps 28 are provided, which are supported on one side on the foot of the wing rail and on the other side on the foot of the frog point. In the unwelded region of the frog, where the point rails are further apart, an inner point fastening in the form of an anchor clamp 29 is provided, which lies on the inwardly facing feet of these two points.

All rail components are therefore tightened elastically and vertically against the ribbed plates but are otherwise decoupled from each other. Each of the three main parts (two wing rails and one frog point) can therefore oscillate completely free from the other parts and deform elastically vertically and horizontally. The impact when the wheel goes from the wing rail to the frog point and vice versa is therefore sharply reduced by the individual elasticity so that the previous wear due to compressive deformation virtually no longer occurs.

Since the main parts are secured essentially only by friction between the rail foot and the ribbed plates because of the anchor clamps, it must be ensured that the main parts cannot be displaced relative to each other or only to the extent that the switch opening 11 still has the adequate width. In order to prevent relative displacement between frog point 3 and the wing rails 1 and 2 in the longitudinal direction of the rails, a rail anchor 30 is provided that is arranged between the ribbed plates 250 and 251, but, alternatively, can also be arranged between ribbed plates 249 and 250. The rail anchor 30 is explained in detail in connection with FIGS. 6 to 11.

In a preferred variant of the rail anchor this acts only in the longitudinal direction of the rails, and thus avoids vertical coupling of the main components so that the moment of inertia in this region is also not increased. The rail anchor 30 is bolted onto the connectors of the frog point 3 and the corresponding wing rails 1 and 2. Accordingly, these wing rails and the point in this region have holes 31 and 32, which are apparent in FIGS. 7 and 8.

FIG. 2 shows in a side view the frog point 3 with the milled point region 6. The transfer region 34 lying between plates 248 and 249 is also apparent, in which the traversal surface of the frog is slightly and relatively lowered by a small amount.

FIG. 3 shows a side view of wing rail 1, wherein the views of FIGS. 1, 2 and 3 are shown aligned with respect to the relative position of the main parts in the longitudinal direction of the rail.

Finally, it is also known from FIG. 1 that all ribbed plates 246–253 and 223 are bolted onto ties (not shown) via tie bolts 33.

In order for the individual rails not to be able to shift across the longitudinal direction of the rails, vertically protruding ribs are provided on the ribbed plates, between which the rail parts are secured essentially without play (within narrow tolerances). Under practical conditions this play amounts to only about 0.5–1 mm maximum. In particular, these ribbed plates are described in detail in connection with FIGS. 12–15.

Finally, it should also be pointed out in connection with FIG. 3 that the wing rail 1 in the region between the two points 35 is slightly cambered, relative to the tread height of the frog point corresponding to the conicity of the wheels so that the wheel on passing from the frog point to the wing rail and vice versa is neither lowered nor raised. The rail surface height of the frog point is depicted by the thinner line 36, which runs flat (horizontally) between points 35 relative to the tread 37 of the wing rail.

Figure 4:
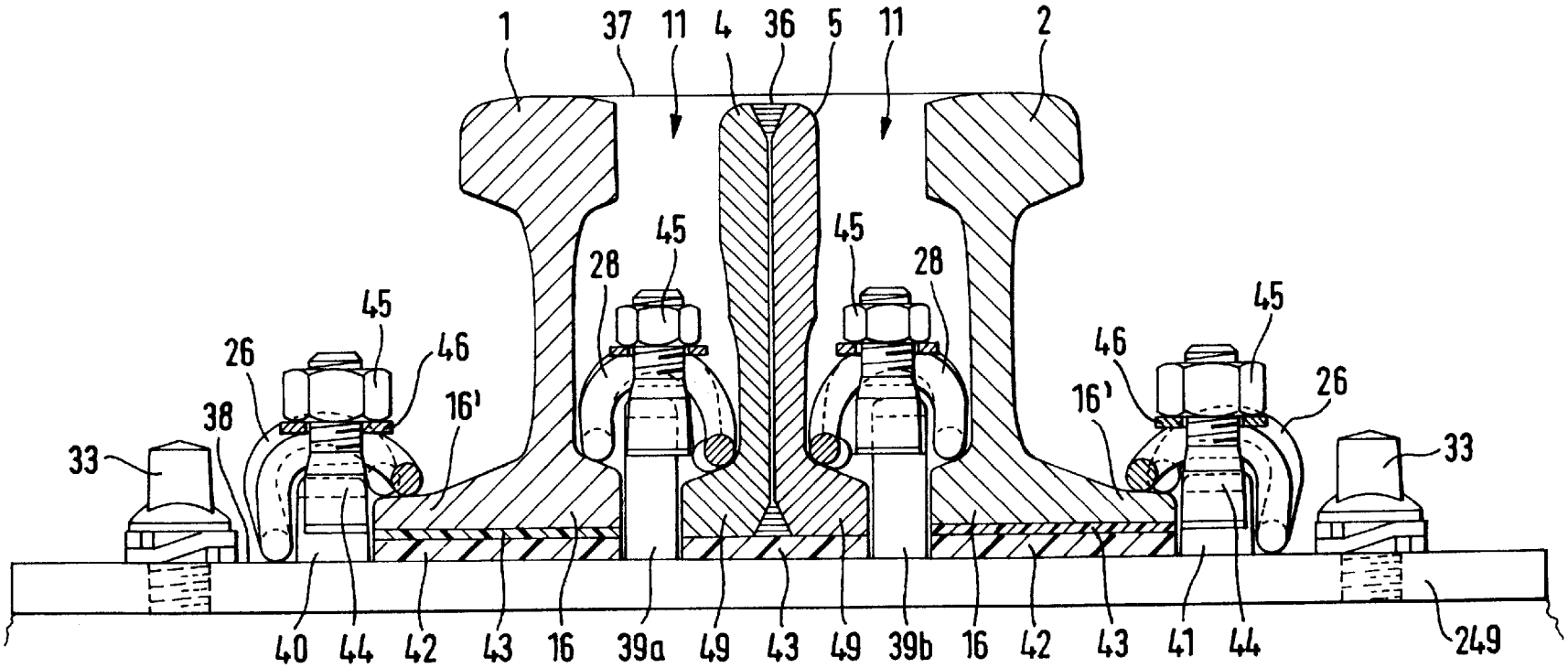
FIG. 4 shows a cross section along plate 249 of FIG. 1.

FIG. 4 shows a cross section along line A—A of plate 249 of FIG. 1. In this region, the frog point 3 has essentially its full height and still bears part of the actual load.

The two continuous point rails 4 and 5 are also welded together on the head and foot by $CO_2$ shielded arc welding.

The ribbed plate 249 has two vertically protruding ribs 39*a* and 39*b* and two lateral lower ribs 40 and 41 opposite them. The respective spacing between ribs 40 and 39*a* on the one hand and 39*b* and 41 on the other corresponds to the width of foot 16 of wing rails 1 and 2 available at this site, in which, in any event, a very limited play of at most 0.5–1 mm is present so that the feet 16 of both wing rails 1 and 2 are fixed between the corresponding ribs 40 and 39*a* on the one hand and 41 and 39*b* on the other in a direction across the longitudinal axis of the rails. The two wing rails 1 and 2 are positioned on spacers 42 that have a thickness of, e.g., 9 mm and are preferably made from an elastic material. An additional spacer 43 is inserted between the spacer and the bottom of the foot, whereby the aforementioned camber of the wing rail can be adjusted relative to the rail surface height of the frog point. These spacers 43 are easily replaced; they can be replaced with thicker spacers when the tread of the wing rails becomes worn, so that the aforementioned resurface welding discussed earlier to improve the tread of the wing rails 1 and 2 is unnecessary.

The parts of the rail feet 16' facing outward are tightened vertically and elastically relative to the top 38 of the ribbed plate via ordinary anchor clamps 26. For this purpose a hook bolt 44 is fastened to the outer ribs 40 and 41 by means of a dovetail fastener. Threaded bolts protrude from the bolt mounts onto which nuts 45 with washers 46 are threaded so that the anchor clamps 26 can be tightened relative to ribbed plate 249 on the one hand, and relative to the outwardly facing feet 16' of the corresponding wing rail 1 and 2 on the other. It is also readily apparent from FIG. 4 that the anchor clamp 26 lies at different heights on the ribbed plate and the foot. Similarly, when the two inner feet of the wing rails 1 and 2 are clamped by an inner wing rail tightener 28 against ribbed plate 249, a hook bolt with nut 45 is also applied to the center ribs 39*a* and 39*b*, via which the anchor clamp 28 is tightened by means of nut 45 and a washer 46. Anchor clamp 27 lies on the two feet 16 and 49 of the corresponding wing rails and the frog point and essentially at roughly the same height.

It is also clearly apparent from FIG. 4 that the two wing rails 1 and 2 are completely decoupled in the vertical direction and therefore can oscillate freely, independently of each other, and bend elastically. As already mentioned, the outer anchor clamps 26 are ordinary clamping elements as used by the Deutschen Bahn AG under the designation SKL 12. The anchor clamp 28 for internal fastening in the top view of FIG. 5 has essentially the same shape as anchor clamp 26. In the cross section of FIG. 4, however, it is distinguished by the fact that both sides lie at essentially the same height on the inner rail feet 16 of the two wing rails and the frog point.

Figure 5:
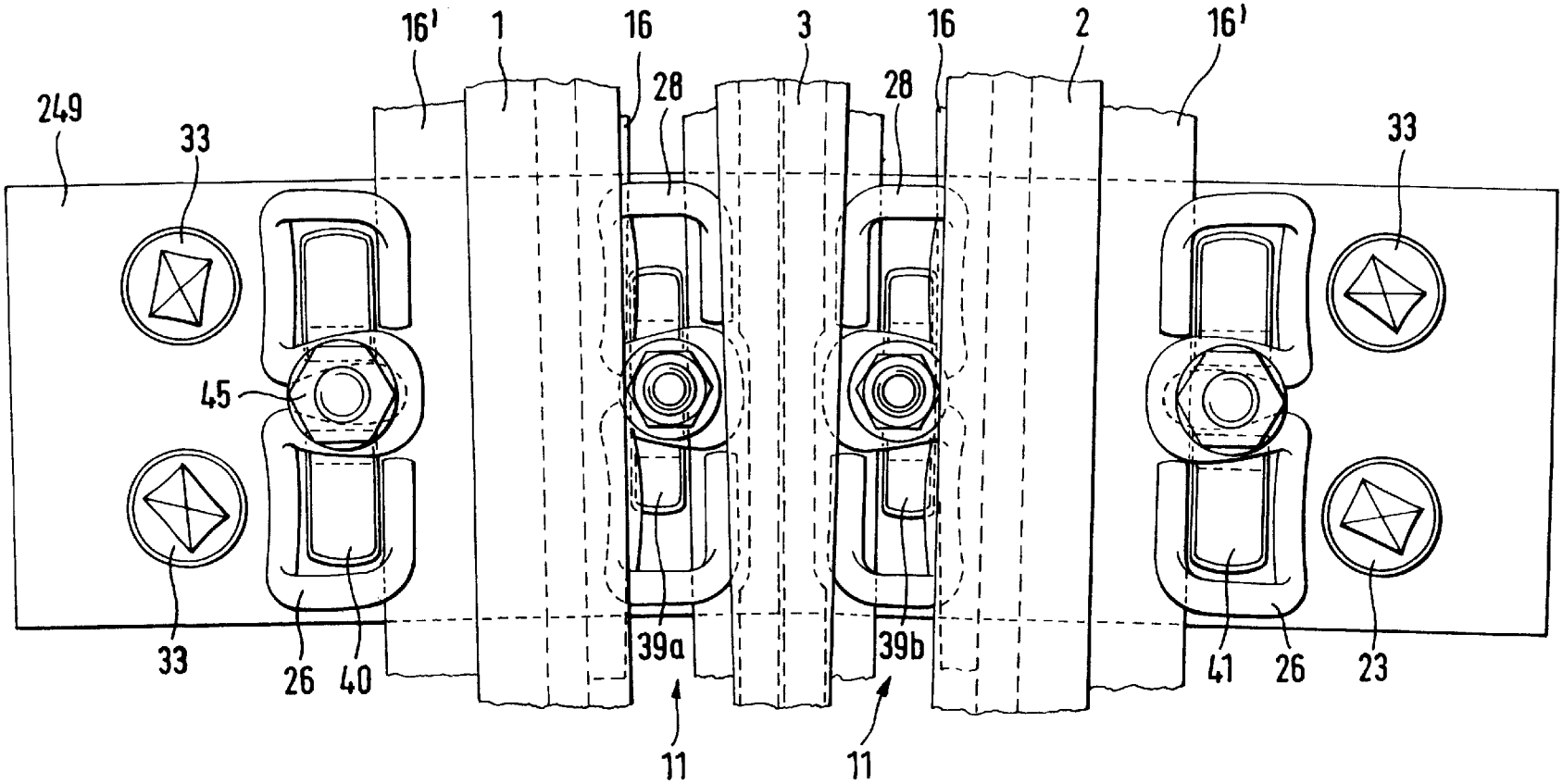
FIG. 5 shows a top view of the cross section of FIG. 4 (on plate 249)

FIG. 5 shows a corresponding top view of the region of the ribbed plate 249. Here again the ribbed plate has four ribs like plate 248, i.e., the two outer, lower ribs 40 and 41 and the two inner, higher ribs 39*a* and 39*b*. The two point rails forming the frog point 3, i.e., the standard rails 4 and 5, are welded to each other at the head and foot and have outwardly facing feet 49 on which inner wing-point rail fasteners are supported, which are also designed here as anchor clamps, but differ from the anchor clamps 28 in that the support on the feet 49 of frog point 3 lies lower than the support on the feet 16 of wing rails 1 and 2.

It should be pointed out that in the region of ribbed plate 249 the two wing rails 1 and 2 are further cambered by a thick additional spacer 43, which is indicated by line 37 (FIG. 4), which represents the height of the contact surface (rail surface) of wing rails 1 and 2 and the downwardly displaced traversal surface 36 of the frog point 3.

Figure 6:
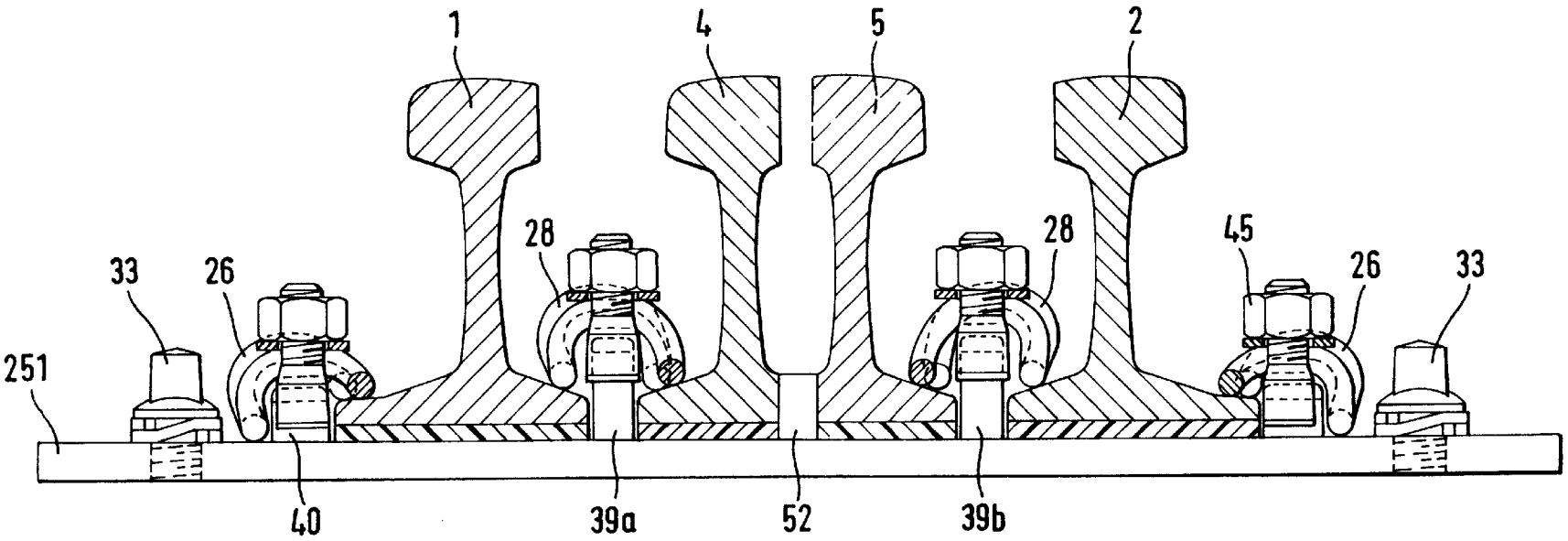
FIG. 6 shows a cross section along plate 261 of FIG. 1.
Figure 7:
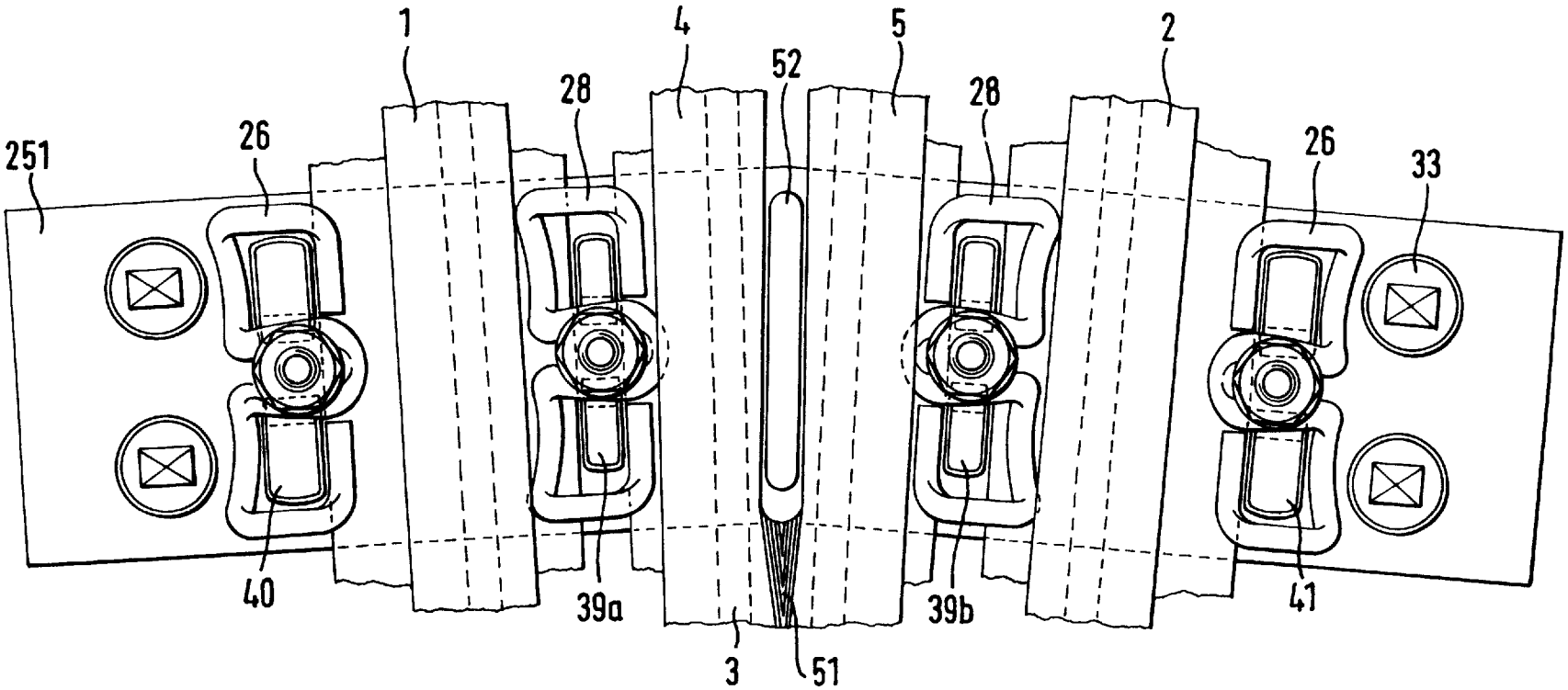
FIG. 7 shows a top view of the cross section of FIG. 6.

FIG. 6 shows a cross section through the ribbed plate 251, i.e., in a region in which the standard rails 4 and 5 merge from a separated point region directly into the welded region of the frog point, which is made apparent by the weld seam 51 of FIG. 7. The ribbed plate here has a total of five ribs, namely the two outer ribs 40 and 41, the two ribs for the wing rail/point rail fasteners 39*a* and 39*b*, as well as a central rib 52 between the point rail 4 and the point rail 5 that holds these two point parts together at a spacing transverse to the longitudinal direction of the rails. Since in this region the outer feet of the point rails 4 and 5 still exhibit essentially the normal rail profile of the standard rails, the anchor clamps for the inner wing-point fastener 28 are designed so that they have the same contact height on either side. In principle, the same anchor clamps can therefore be used as in the inner wing rail fastener of FIGS. 4 and 5. It should also be noted that the two wing rails in the object of the invention already end after plate 251, whereas according to the prior art these end only behind plate 253. Shortening was possible because of the much greater horizontal elasticity of the two wing rails which are tightened only at the foot.

FIG. 7 shows a top view of the section of FIG. 6. Here the region of transition from the welded part of the frog point 3 (weld seam 51) to the standard rails 4 and 5 is readily apparent, as well as the narrower rib 52.

Figure 8:
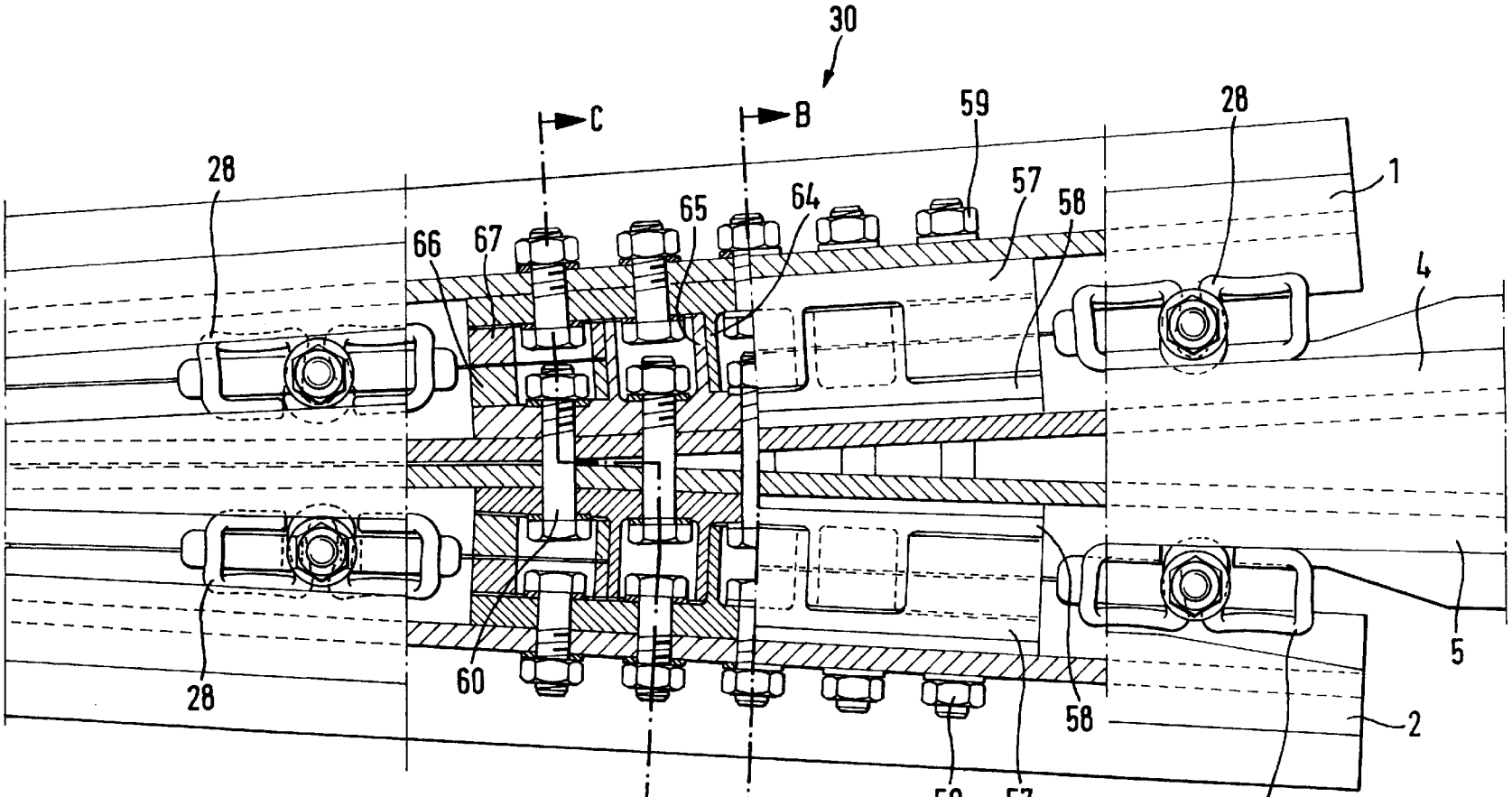
FIG. 8 shows a top view of a part of the frog according to the invention with a rail anchor device according to a first variant of the invention.

FIG. 8 shows a first variant of the rail anchor 30, with five bolts (cf. FIG. 1) and a top view with the omission of the point and wing rail heads, which lies in the region of the frog point between the ribbed plates 250 and 251, i.e., in a region in which the two point rails are already welded together at the head and foot. The rail anchor 30 consists of two pairs of rail anchor elements 57 and 58, the outer elements 57 of which are respectively tightened with the wing rail 1 and 2 and the inner elements 58 of which are tightened on the corresponding frog point 3. Attachment preferably occurs by means of HB bolts 59, which pass through hole 32 (FIG. 3) of the wing rail, as well as with bolts 60, which pass through holes 31 of the two pointrails 4 and 5. Both rail anchor elements 57 and 58 that form a pair have base elements 62 and 63, respectively, extending parallel to the corresponding connector of the rail and protruding into the fishplate seating surface 18 of wing rails 1 and 2 or the fishplate seating surface 61 of point rails 4 and 5, the base elements being tightened by the corresponding bolts 59 and 60 in the fishplate seating surfaces and opposite the connector of the rail. Each rail anchor element 57 and 58 also has respective stop element 64 and 65 protruding perpendicular to the longitudinal axis of the rails horizontally from the respective base elements 62 and 63, which are displaced relative to each other in the longitudinal direction of the rails so that the stop elements 64 and 65 of one respective pair 57, 58 intermesh in comb-like fashion and thus form stops in the longitudinal direction of the rails against relative longitudinal shifting of adjacent rails 1, 4 and 5, 2, respectively. The stop elements are hence shaped so that during the laying of rails in the track the point rails 4 and 5 are initially positioned on the ribbed plates with the attached rail anchor elements 58 and then the wing rails with the attached rail anchor elements 57 are lowered, during which time the stop elements 57 and 58 intermesh in comb-like fashion and ensure relative alignment of the rails longitudinally. The stop elements 64 and 65 of the corresponding rail anchor elements 57 and 58, as is apparent from FIG. 9, form an open cavity 73 relative to the opposite rail in order to guarantee insertion of the bolt 59 and acceptance of the bolt head.

Figure 9:
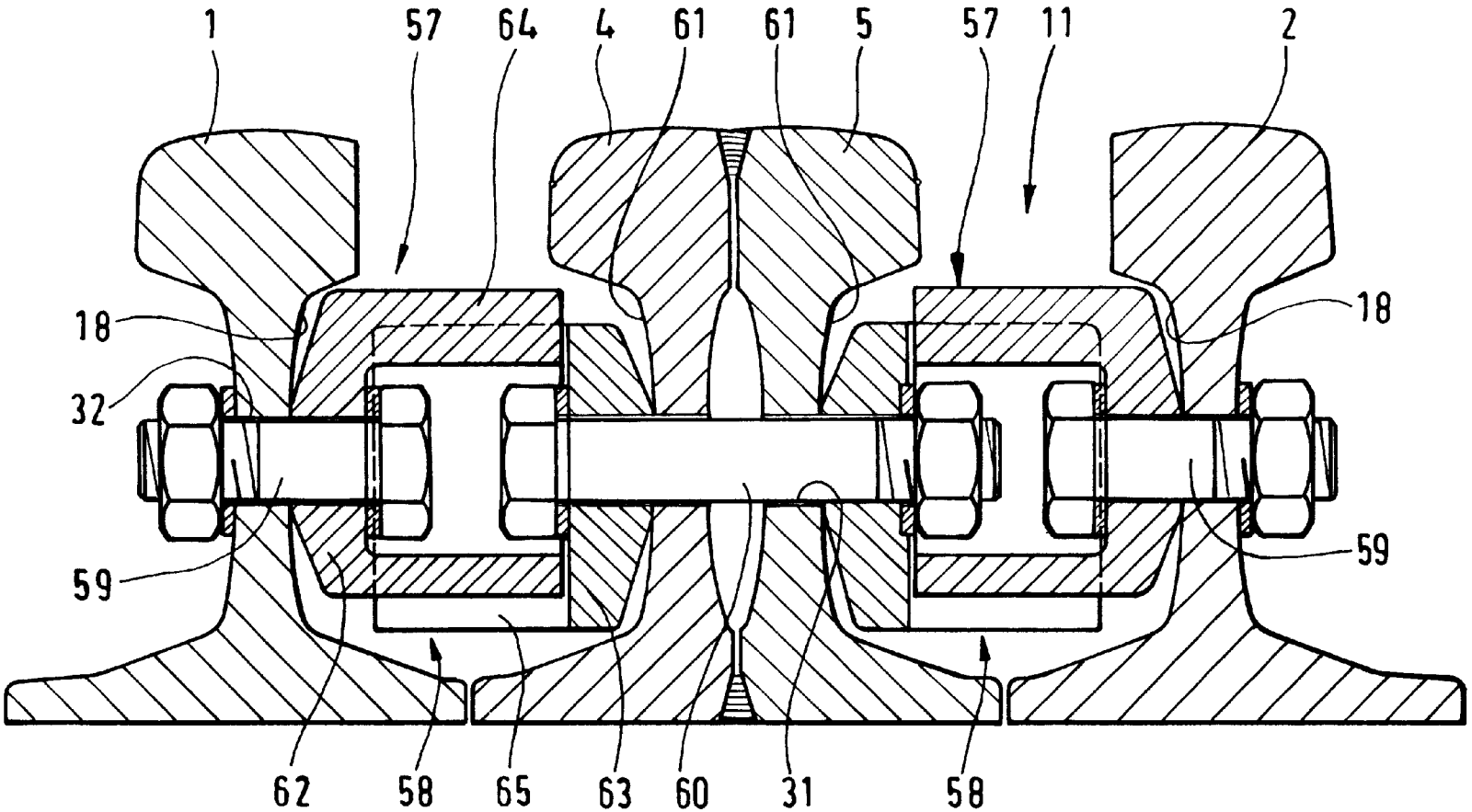
FIG. 9 shows a cross section along line B—B of FIG. 8.

To also ensure spacing of the rails and thus width of the switch opening, the stop elements, as shown in the left part of FIG. 8 and in FIG. 9, have vertically extending wall sections 67 and 68 that intermesh and thus form a stop in a direction perpendicular to the longitudinal axis of the rails in the Y direction. These vertical wall sections 67 and 68 extend only over roughly half the length of stop elements 64 and 65 measured perpendicular to the longitudinal axes of the rails and begin on the free end of the stop elements. They run on the vertical stop element 67 from the bottom up connected to standard rails 4 and 5, i.e., from the rail foot in the direction toward the rail head, whereas, on the other hand, the vertical wall sections 68 connected to the wing rails 1 and 2 run from the top down, i.e., from the rail head to the rail foot in order to make it possible for the wing rails to be inserted from above with their rail anchor elements.

Although the adjacent rails 1 and 4 and, respectively, 5 and 2 are connected to each other via the rail anchor elements, the coupling is not rigid, as is the case with the ordinary filling plates, for example, but the rail parts can bend, move or oscillate vertically, independently of each other, and are therefore fully decoupled from each other relative to the moment of inertia in the vertical direction, especially since the arrangement with its main mass is provided in the vicinity of the neutral X axis.

Figure 11:
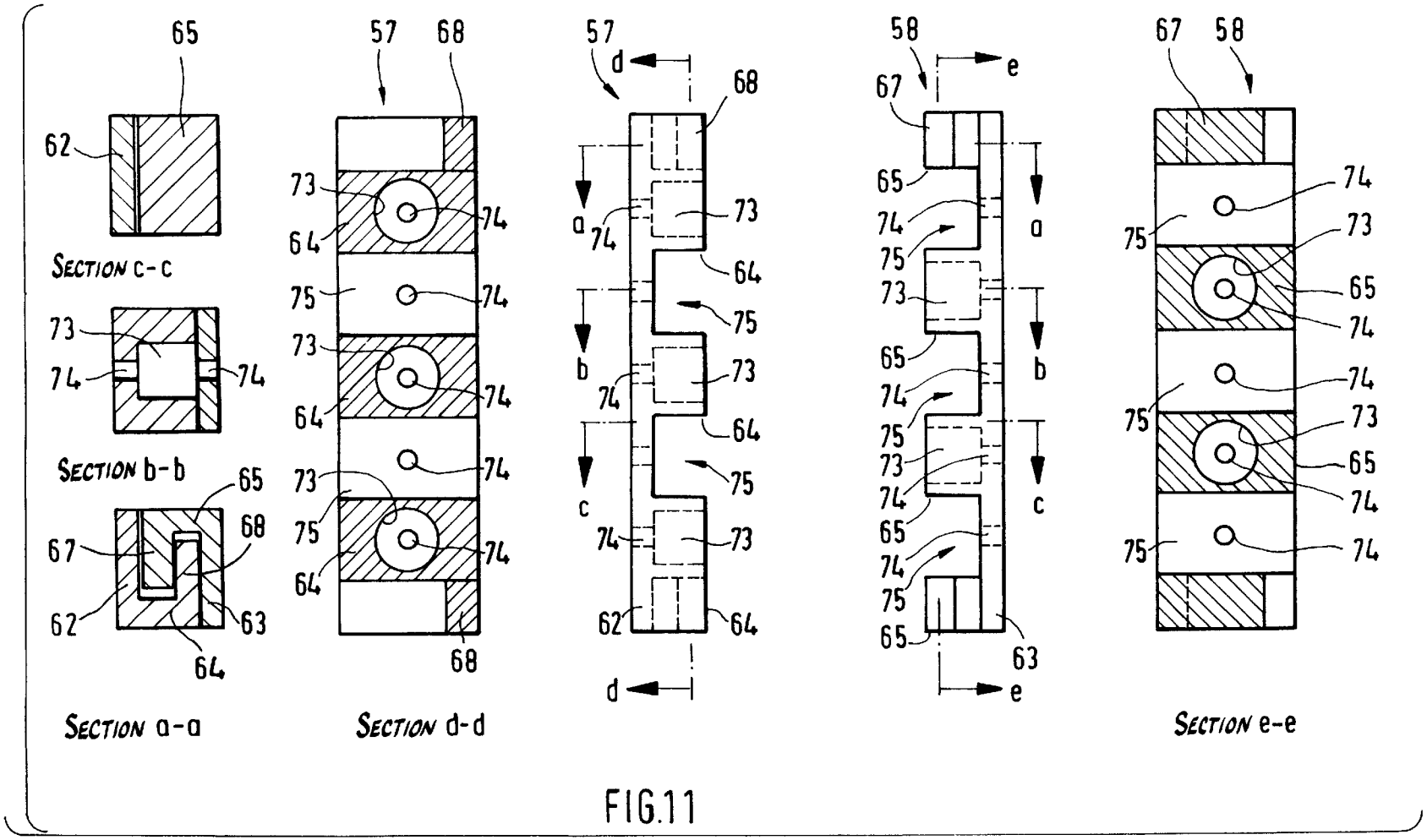
FIG. 11 shows different views and cross sections according to the first variant of the rail anchor.

The rail anchor is best shown in FIG. 11. Each rail anchor element 57 and 58 has stops 64 and 65 which have recesses 75 in between that accept the opposing stops 64 and 65 so that the rail anchor elements intermesh in comb-like fashion. The stops 64 and 65 protruding from the corresponding base elements 62 and 63 have a cylindrical opening 73 with a hole 74 in the bottom of the opening for passage of the fastening bolt. The two end stops of each rail anchor element 57 and 58 have vertically running arms 67 and 68, which also intermesh (cf. section A—A) so that the wing rails and frog point are also held against each other in the direction transverse to the longitudinal axis of the rails, i.e., in the Y direction, so that the rails are secured against tilting. No coupling in the vertical direction is present here either, which should be emphasized in particular, so that all rails, i.e., the frog point and the two wing rails, can move up and down freely relative to the other rails; in this respect, only the moment of inertia of the individual rails is effective, which significantly increases vertical elasticity.

Figure 10:
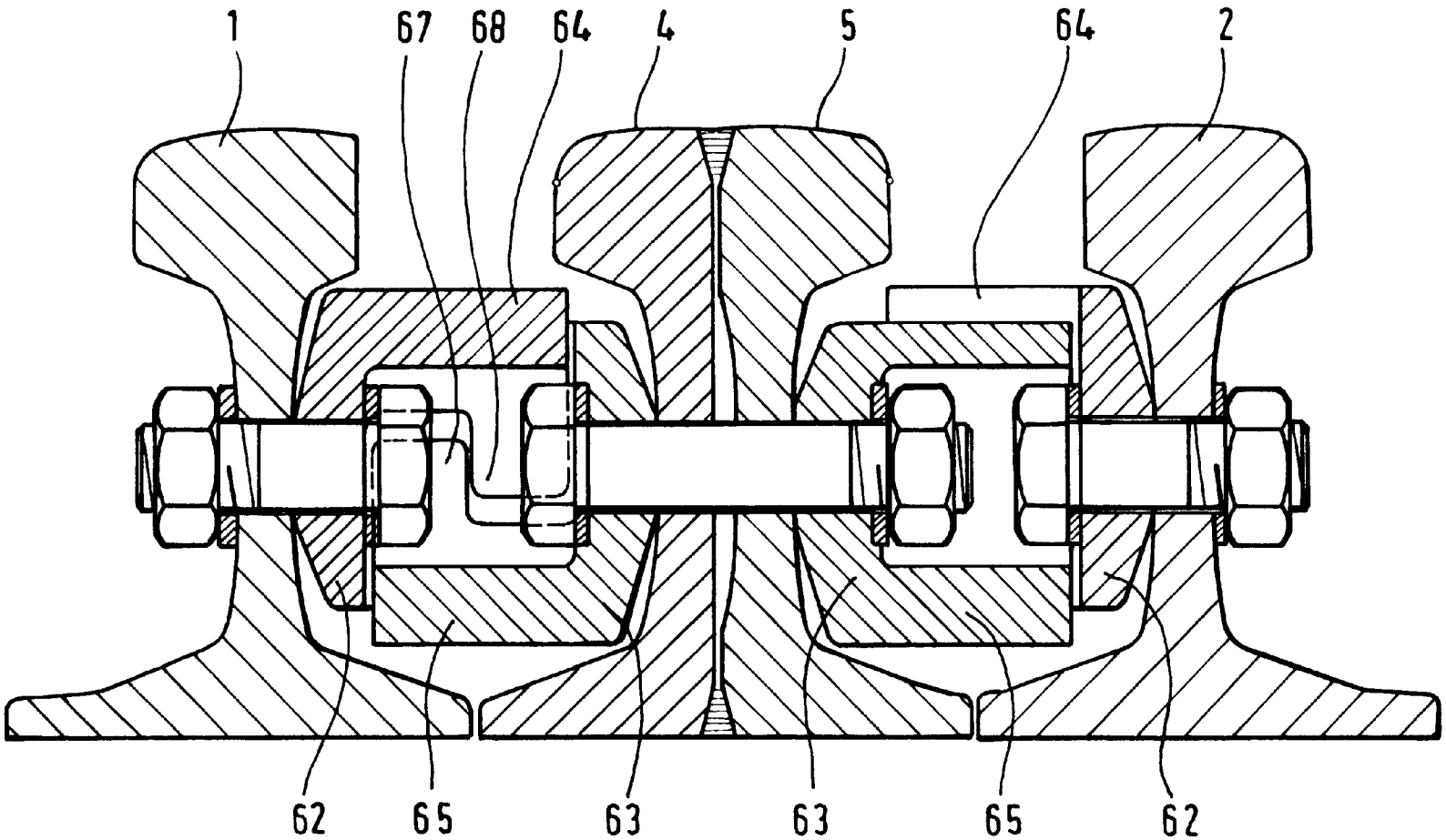
FIG. 10 shows a cross section along line C—C of FIG. 8 through the rail anchor according to the first variant of the invention.

Additional details are readily apparent to a person skilled in the art from FIGS. 9–11.

Figure 12:
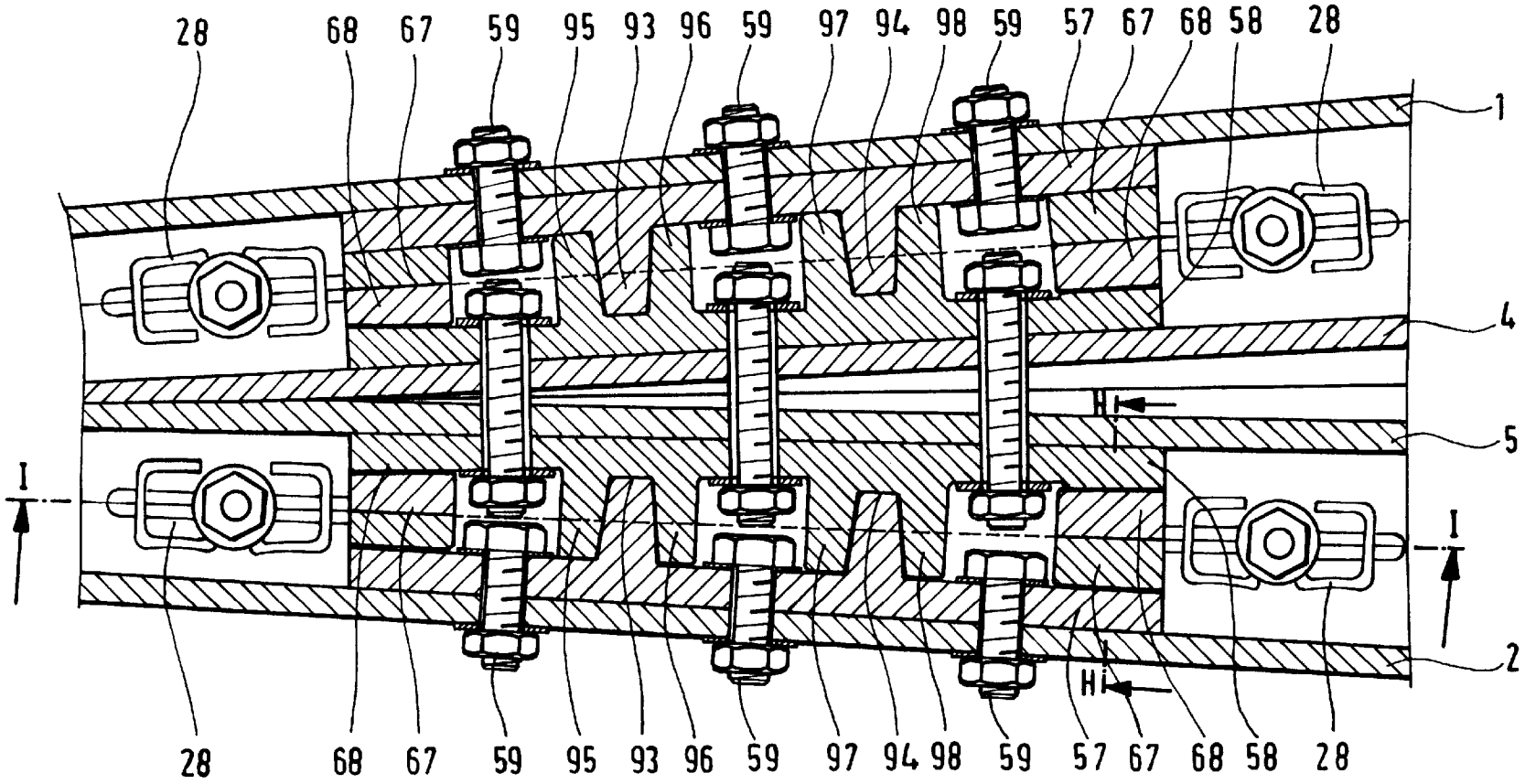
FIG. 12 shows a cutaway top view of part of the frog according to a second variant of a rail anchor according to the invention.

FIG. 12 shows a variant of a rail anchor with three bolts in a cutaway top view. Here again the rail anchor consists of two pairs of rail anchor elements 57 and 58, the outer elements 57 of which are tightened by means of three bolts 59 to the connector of the wing rails 1 and 2, and the inner elements 58 of which are also tightened by three bolts 60 to the connectors 4 and 5 of the standard rails forming the frog point. The aforementioned connectors each have holes to accommodate the bolts. Here again both rail anchor elements 57 and 58 of a pair have base elements 62 and 63 that extend parallel to the corresponding connector of the rail and protrude into the fishplate seating surfaces of the wing rails or point rails, from which teeth 93–98 protrude that serve as stops and intermesh in comb-like fashion. The rail anchor element 57 attached to wing rail 1 and 2 then has two teeth 93 and 94 offset relative to each other in the longitudinal direction of the rails, whereas the rail anchor element 58 applied to standard rail 4 has two pairs of teeth 95, 96 and 97, 98, between which appear teeth 93 and 94, respectively. In the embodiment example of FIG. 12 the teeth 93 and 94 in the top view are trapezoidal and have a wide base so that the teeth absorb greater forces. The gaps between teeth 95, 96 and 97, 98 are correspondingly trapezoidal so that the rail anchor elements intermesh with limited play (2–3 mm). Since a force component acting transverse to the longitudinal direction of the rails is also present with the forces acting in the longitudinal direction of the rails due to the trapezoidal shape of the teeth, intermeshing hooks 67, 68 that absorb these transverse force components are provided at both ends of the pair of rail anchor elements 57, 58.

Figure 13:
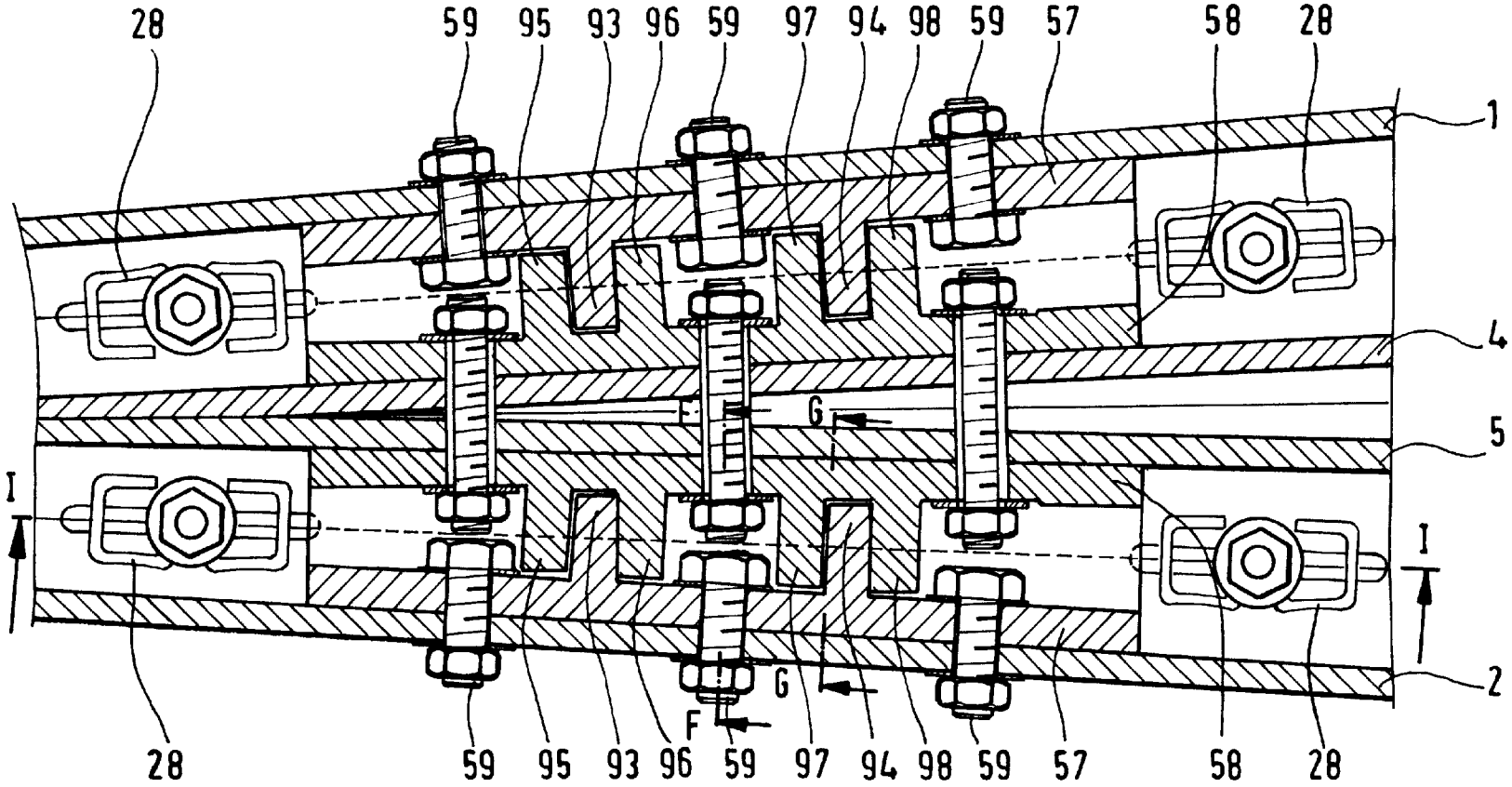
FIG. 13 shows a cutaway top view of part of the frog according to a third variant of the rail anchor according to the invention.

The variant of FIG. 13 differs from that of FIG. 12 in that the teeth 93–98 have a rectangular profile in the top view, for which reason the hooks are also omitted.

As is apparent from the cross sections of FIGS. 15*a* and 15*b*, the individual teeth of a rail anchor element are connected to each other by connectors 99 and 100, in which these connectors lie parallel to the plane of travel and are offset. In the embodiment example shown, the connector 99 of the rail anchor element 58 connected to the frog point lies above the connector 100 of the rail anchor element 57 connected to the wing rail. The frog can therefore be inserted from the top with the wing rail already fastened in the track.

FIG. 15*c* shows a cross section of the hooks that absorb the transverse forces.

FIG. 14 shows as a cross section along line I—I of FIG. 13 the comb-like intermeshing of teeth 93–98 and the connectors 99 and 100 that bridge the teeth.

Figure 17:
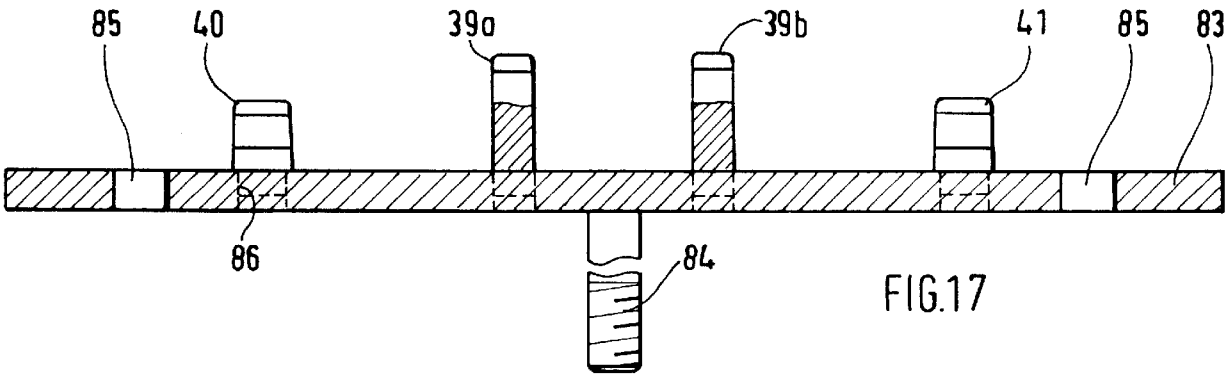
FIG. 17 shows a cross section along line E—E of FIG. 16.
Figure 16:
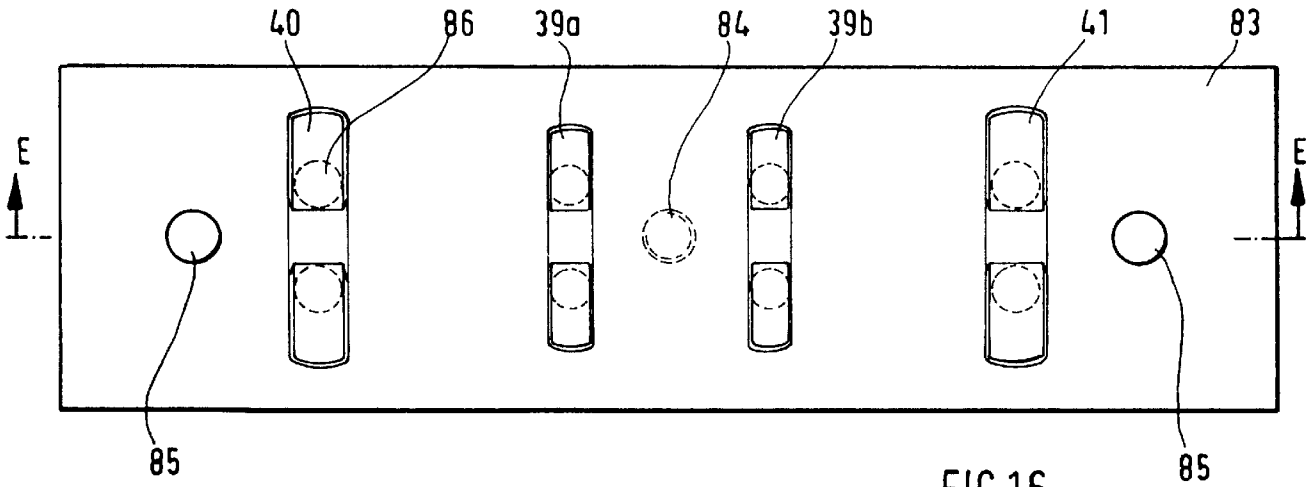
FIG. 16 shows a top view of a ribbed plate used in the invention.

FIG. 16 shows a top view and FIG. 17 a cross section of the ribbed plates used in the invention. The embodiment example depicted here with four ribs is considered for the ribbed plates 250 and 251 in FIG. 1, in which it is pointed out that the ribs in FIGS. 12 and 15 run parallel to each other and perpendicular to the edge of the ribbed plate, whereas under practical conditions (cf. FIG. 1) they must naturally be aligned under the acute angle under which the rails run. The ribbed plate consists of an elongated, rectangular flat plate 83 from the top of which the ribs 40, 29*a*, 39*b* and 41, protrude perpendicularly. The spacing between the opposing surfaces of ribs 40 and 39*a*, as well as 39*b* and 41 corresponds externally to half the foot width within the shortened foot of the wing rails and the spacing between the opposing sides of ribs 39*a* and 39*b* corresponds to the adjusted width of the foot of the two welded frog point rails. The ribbed plates also have on both sides a hole 85 through which fasteners can pass (for example, wooden tie spikes 33 in FIG. 1 or also through-bolts for concrete ties) for attachment to the tie.

The ribs 40 and 41 on the one hand, and 39*a*, 39*b* on the other have different heights and account for the different heights of the support points of the anchor clamps. The ribs have a square base element and are fixed to plate 83, either by stub welding or by hole welding in which short cylindrical pins 86 that are forged onto the ribs are inserted into the holes of plate 83.

Figure 19:
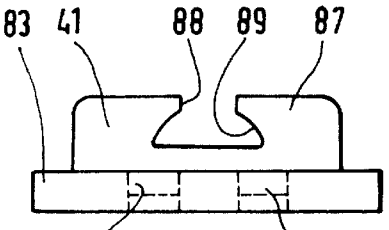
FIG. 19 shows a side view of the outer rib of the ribbed plate of FIGS. 16 and 17.
Figure 18:
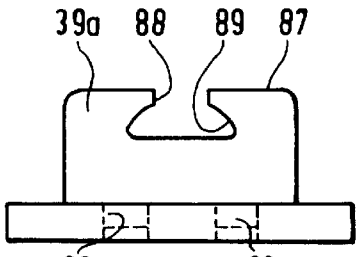
FIG. 18 shows a side view of an inner rib of the ribbed plate of FIGS. 16 and 17.

FIGS. 18 and 19 show side views of ribs 39*a* and 41, respectively. All ribs have on their upper side 87 a rectangular opening 88, as it appears in the top view of FIG. 17 [sic; 16], which widens downward toward plate 83 into a dovetail-shaped recess 89. The dovetail bolt mounts 44 (FIG. 4) are secured to the ribbed plate via these dovetail-shaped recesses 89.

Figure 20:
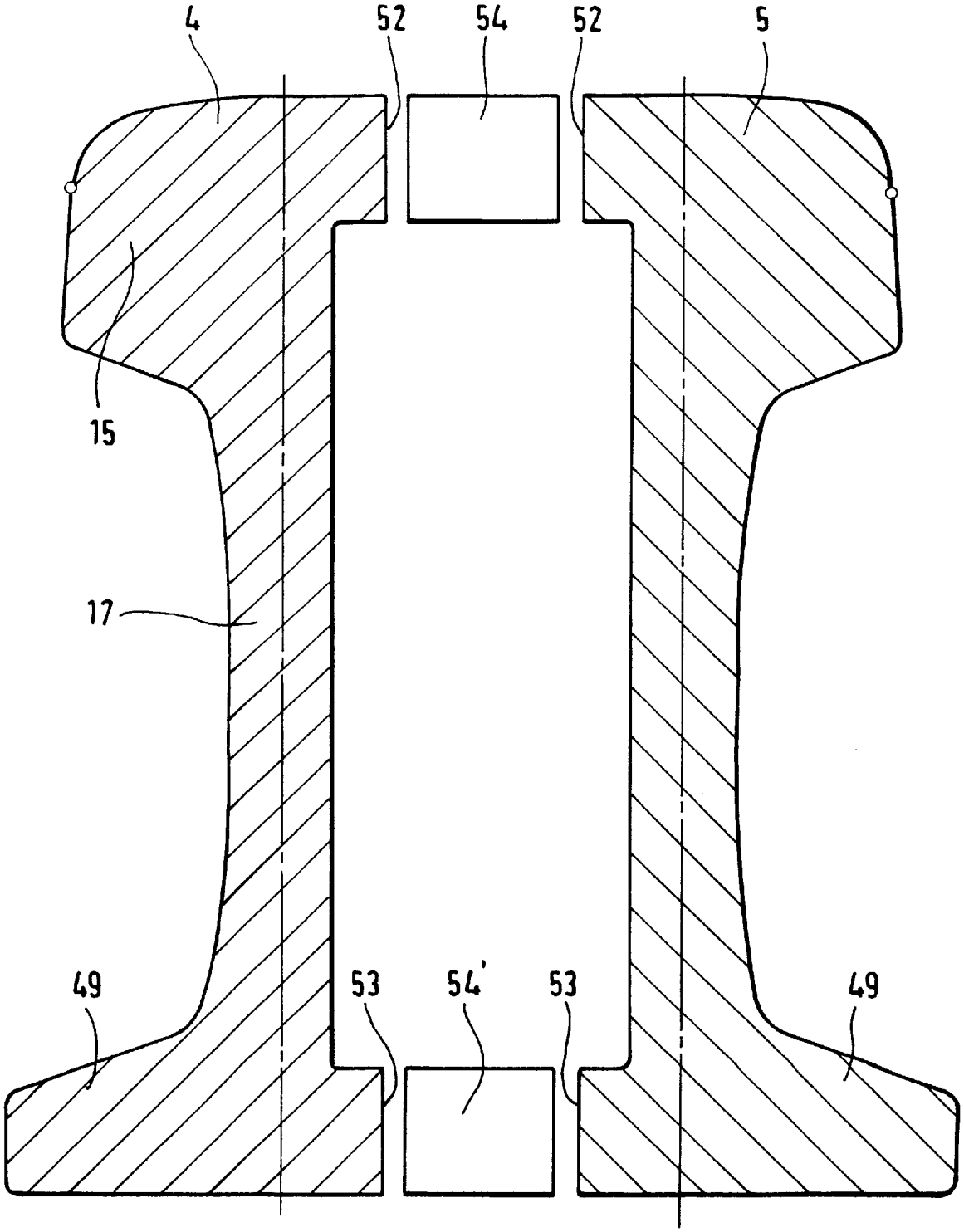
FIG. 20 shows a cross section of two rail parts forming a frog point during the preheating process for open pressure welding.

FIG. 20 shows a cross section of two control rails forming the frog point before "open" welding. The section is taken roughly between ribbed plates 249 and 250 of FIG. 1. The point rails 4 and 5 to be welded together are prepared on the opposing surfaces of rail head 15, foot 16 and web 17, wherein the rails here are welded together only at surfaces 52 in the head region and 53 in the foot region. In the embodiment examples of FIGS. 20 and 21, so-called open welding is involved in which the surfaces 52—52 and 53—53 being welded together have a horizontal space in which an acetylene-oxygen torch or inductive heater "or laser with equalization film". 54 and 54', respectively, is arranged for heating. The surfaces being welded are heated to the welding temperature by this torch or heater. The torch or heater 54 and 54' is then removed from this region, for example, by being pivoted out, and the two rail regions are pressed together to produce weld seams 55 and 56. This open pressure welding is characterized by a relatively small bead. A situation is also achieved in which the two rail connectors 17 lie relatively close together and their spacing 56' is only at most about 3–4 mm so that the stability is substantially increased, especially in the front point region of the frog point 3.

Figure 21:
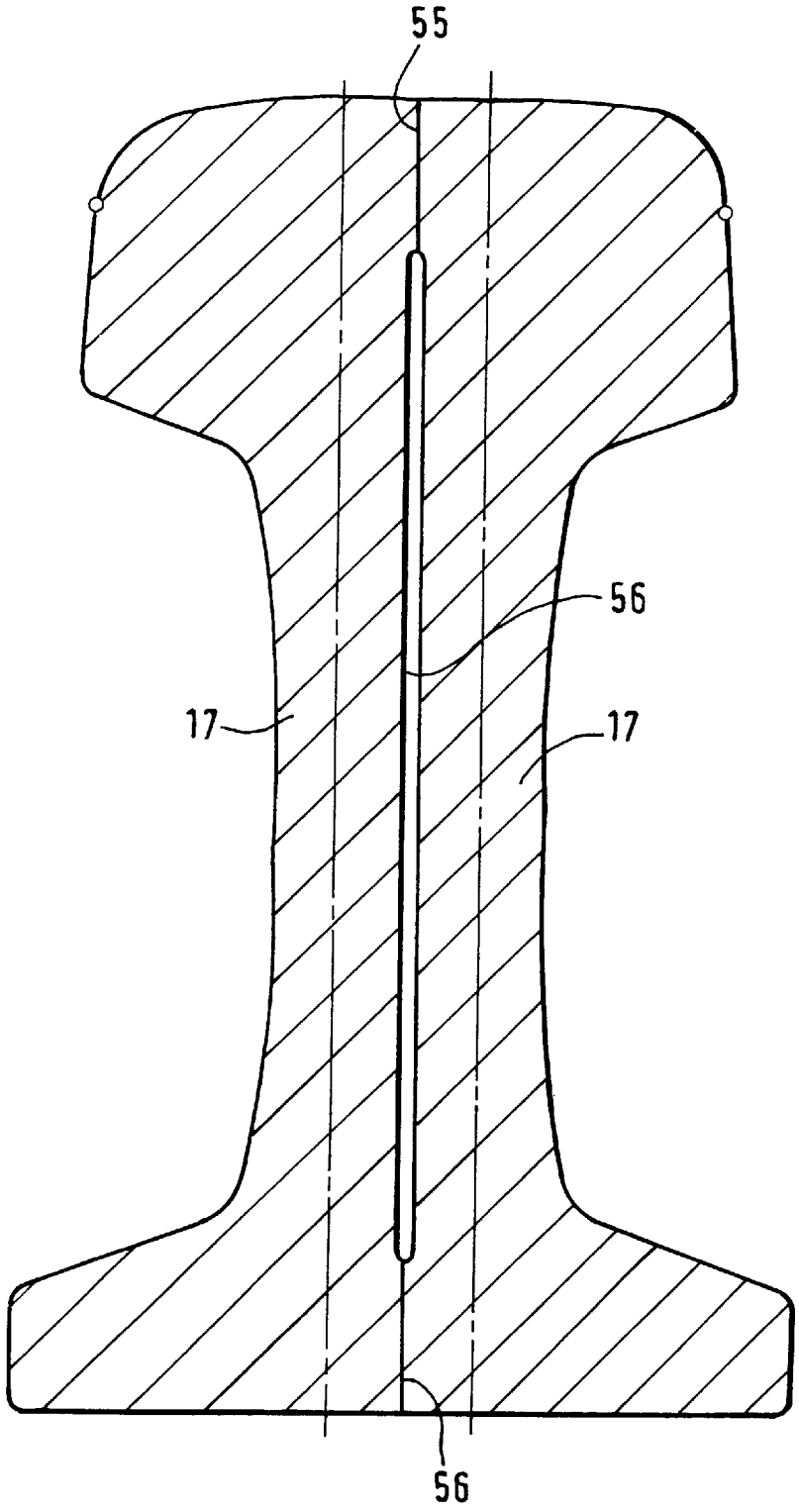
FIG. 21 shows a cross section similar to FIG. 20, but after completion of open pressure welding.

FIG. 21 shows the frog point after welding of the foot of weld seam 56 and of the head at weld seam 55.

Figure 22:
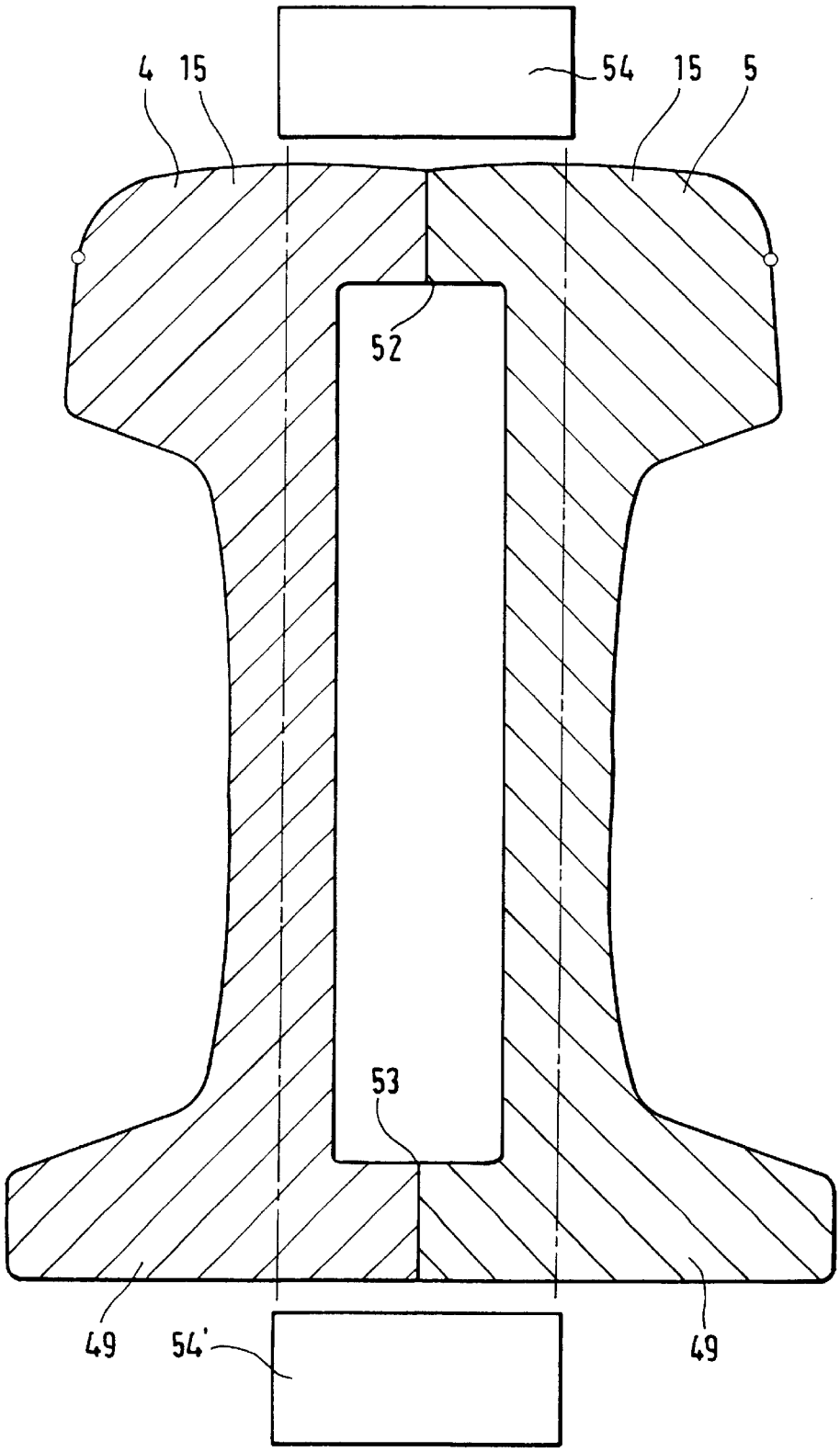
FIG. 22 shows a cross section similar to FIG. 20 of two rail parts forming a frog point during the preheating process for closed pressure welding.
Figure 23:
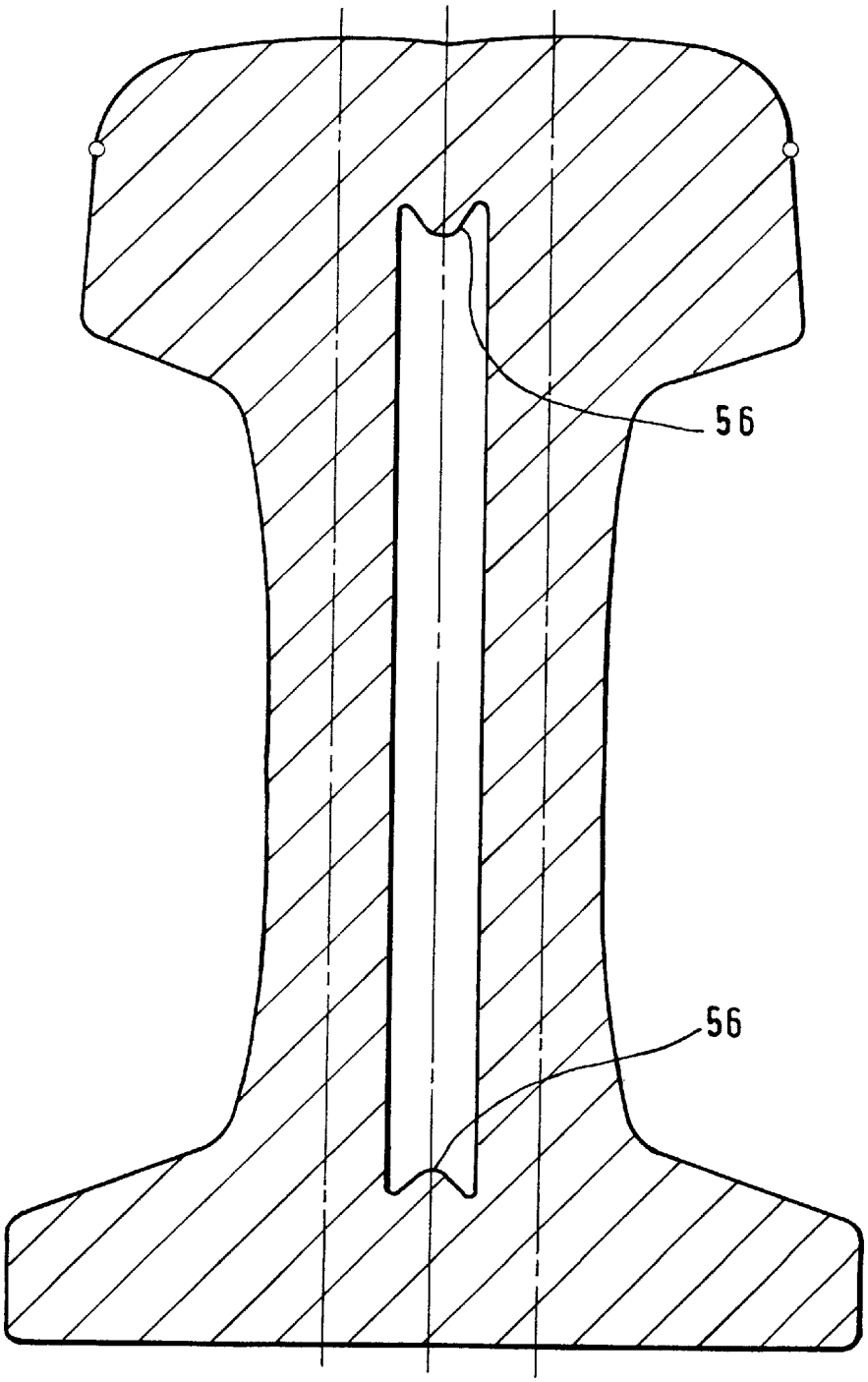
FIG. 23 shows a cross section according to FIG. 22 after completion of closed pressure welding.

FIGS. 22 and 23 show a similar view to FIGS. 20 and 21 but for closed pressure welding. The heating units 54 and 54' are arranged above head 15 and beneath foot 49 of the point rails 4 and 5 and the surfaces 52 and 53 to be welded together are pressed against each other with a certain preliminary pressure.

After preheating has occurred and the pressure drops because of material softening, the welding process is started automatically. The weld seems can have a significant length of 1–2 m or even longer. Despite such lengths, the pressure-welded seams exhibit excellent material quality, since no additional welding material is used and the critical additional preheating practically disappears, which is otherwise used during welding with $CO_2$ shielded arc welding according to the prior art.

It is apparent from FIG. 23 that the bead 56 during closed welding turns out to be somewhat larger than during open pressure welding. This bead is removed from the outside of the head and foot, for example, by grinding, as has already occurred in the depiction of FIG. 23.

What is claimed is:

1. A rigid railroad frog for switch points and crossings comprising:

two wing rails each having a foot;

a frog point defining a rail surface, the frog point having a foot and being arranged between the wing rails, the wing rails and frog point defining switch openings therebetween which extend at an acute angle relative to one another for free passage of a wheel flange of a wheel;

a ribbed plate having vertically protruding ribs, the wing rails and frog point supported on the ribbed plate and secured to the ribbed plate by vertically oriented elastic anchor clamps, the foot of each wing rail and the foot of the frog point being fitted between the ribs to inhibit horizontal motion of the wing rails and the frog point transverse to a longitudinal direction of the wing rails and to thereby fix the width of the switch opening, the wing rails and the frog point fixed against said horizontal motion solely by the ribs.

2. The railroad frog according to claim 1 wherein the wing rails and the frog point are positioned on spacers which are arranged between the foot of the corresponding rail or frog point and the ribbed plate.

3. The railroad frog according to claim 2 wherein the spacers are made of an elastomer.

4. The railroad frog according to claim 2 wherein the wing rails in a region traversed by the wheel are cambered relative to the height of the rail surface of the frog point by additional spacers of a predetermined thickness corresponding to the shape of the wheel.

5. The railroad frog according to claim 4 wherein each elastic anchor clamp engages only the foot of a corresponding wing rail or frog point and is attached to a corresponding rib.

6. The railroad frog according to claim 4 wherein the anchor clamps are supported in a milled front region of the frog point positioned on top of a lowered transfer region of the frog point and the adjacent foot of each wing rail and are attached to the ribs.

7. The railroad frog according to claim 6 wherein each anchor clamp positioned between the wing rails exerts a tensile force of 10–15 kN.

8. The railroad frog according to claim 6 wherein certain of the ribs of the ribbed plate are positioned between the wing rails and have a smaller width than ribs of the ribbed plate positioned other than between the wing rails.

9. The railroad frog according to claim 8 further comprising a transition region and a rail anchor device engaging the wing rails and the frog point in the transition region which inhibits displacement of the wing rails and frog point relative to each other in the longitudinal direction of the wing rails but permits vertical bending or oscillation of the wing rails and frog point.

10. The railroad frog according to claim 9 wherein the rail anchor device includes a pair of interengaging stop elements attached to a web of the frog point and the corresponding wing rail wherein the interengaging stop elements extend along the longitudinal direction of the wing rails.

11. The railroad frog according to claim 10 wherein the stop elements each have interengaging vertical arms forming a stop in a direction transverse to the longitudinal axis of the rails.

12. The railroad frog according to claim 1 wherein the frog point comprises two control rails having a head region and a foot region, the control rails welded together at a head region and a foot region by welds extending the length of the frog point.

13. A rigid railroad frog for switch points and crossings comprising;

two wing rails each having a foot;

a frog point defining a rail surface, the frog point having a foot and being arranged between the wing rails, the wing rails and frog point defining switch openings therebetween which extend at an acute angle relative to one another for free passage of a wheel flange of a wheel;

a ribbed plate having vertically protruding ribs, the wing rails and frog point supported on the ribbed plate and secured to the ribbed plate by vertically oriented elastic anchor clamps, the foot of each wing rail and the foot of the frog point being fitted between the ribs to inhibit horizontal motion of the wing rails and the frog point transverse to a longitudinal direction of the wing rails and to thereby fix the width of the switch opening, the wing rails and the frog point fixed against said horizontal motion solely by the ribs, the wing rails being free of coupling to one another.

* * * * *